US012233990B1

(12) United States Patent
Tylaska et al.

(10) Patent No.: US 12,233,990 B1
(45) Date of Patent: Feb. 25, 2025

(54) COMBINATION PAD EYE AND FAIRLEAD DEVICE

(71) Applicants: Timothy Thomas Tylaska, Preston, CT (US); Thomas Willard Dixon, New London, CT (US)

(72) Inventors: Timothy Thomas Tylaska, Preston, CT (US); Thomas Willard Dixon, New London, CT (US)

(73) Assignee: Timothy Thomas Tylaska, Preston, CT (US)

( * ) Notice: Subject to any disclaimer, the term of this patent is extended or adjusted under 35 U.S.C. 154(b) by 486 days.

(21) Appl. No.: 17/678,605

(22) Filed: Feb. 23, 2022

(51) Int. Cl.
*B63B 21/10* (2006.01)

(52) U.S. Cl.
CPC ..... *B63B 21/10* (2013.01)

(58) Field of Classification Search
CPC ..... B63B 21/00; B63B 21/10
USPC ..... 114/218
See application file for complete search history.

(56) References Cited

U.S. PATENT DOCUMENTS 3,233,934 A * 2/1966 Osborn ..... F16G 11/14 114/218
8,025,431 B1 * 9/2011 Burke ..... B63B 21/045 114/218

* cited by examiner

*Primary Examiner* — Lars A Olson

(57) ABSTRACT

A device is presented that can be used as both a pad eye and as a fairlead independently and simultaneously while providing separation between the two modes of use. The device provides the option for multiple attachment points and multiple fairlead passages and reduces the need of requiring both a pad eye and additional hardware such as a pulley in applications such as the implementing of a jib sheet "in-hauler" system on a sailing vessel. Additionally, the device is configured in a symmetric manner so as to allow the device to be optionally joined and mated to a second but inverted such device allowing for the assembly of two such devices into a single combined unit. Such a combined configuration has the benefit of allowing for pad eye and fairlead functions to take place in a suspended location instead of being constrained to only a fixed surface.

16 Claims, 19 Drawing Sheets

COMBINATION PAD EYE AND FAIRLEAD DEVICE

CROSS-REFERENCE TO RELATED APPLICATIONS

None

FEDERALLY SPONSORED RESEARCH

None

SEQUENCE LISTING

None

TECHNICAL FIELD

The invention relates to pad eyes and fairleads used with the securing and redirecting of rigging lines, especially on sailing vessels.

BACKGROUND OF THE INVENTION

In the field of sailing, there has been a steady transition from the use of conventional pulley blocks to that of non-moving fairleads as a means of redirecting lines. In the field of sailing, a "line" is generally the term used to describe a rope while a "block" is the term used to describe a pulley. This transition from pulleys to fairleads has been made possible by the availability of new line materials such as ultra-high molecular weight polyethylene fibers which have extremely low friction coefficients. Fairleads are currently used on many sailboats today, but due to frictional losses fairleads were until recently generally restricted to very small line angle changes and limited to uses such as guides for feeding lines into conventional turning blocks. With the introduction of new low friction line materials, the additional friction loss incurred between using a static fairlead and a conventional pulley is now small enough to allow for turning angles in the range of 90 degrees or greater without unacceptable friction losses. This resulting greater range of turning angles presents the possibility to greatly simplify certain aspects of rigging systems by eliminating the use of bulky, heavy and expensive bearing pulleys and instead use simple static posts, fairleads or bushings to change the direction of pull of tensioned lines.

In many instances on a sailing vessel, pad eyes are used to secure the lines and hardware used with the rigging of the vessel. There are several areas on sailboats in particular that require the use of both a pad eye and a method for redirecting a line, with both operations required to take place in the same approximate physical location. One area in particular pertains to the control of the lead angle of the line connected to the clew of the jib sail. This line in generally referred to as the "jib sheet" and the curvature of the jib sail is controlled in part by the length of the jib sheet and the direction of its pull relative to the jib sail clew. Such parameters have a large effect on the aerodynamic shape and efficiency of the jib sail and need to be constantly adjusted to optimize boat speed as the wind or boat direction changes. The length of the jib sheet is easy to control by letting out or pulling in on the jib sheet, but the vector direction of the pull of the jib sheet with respect to the jib clew is more difficult to control. A pulley or a line redirecting bushing typically known as a rigging "bull's eye" pulling inward in a location generally mid span on the jib sheet is currently the state of the art method to deflect the jib sheet and hence control the lead angle of the jib sheet with respect to the clew of the jib. In the field of sailing, such an arrangement is generally referred to as an "in-hauler" system. The inward and outward motion of this "in-hauler" is controlled by an additional line that is generally redirected in a typical angle of 90 degrees and run back to the boat cockpit so that the crew can make such adjustments without having to climb out on the deck. The state-of-the-art system becomes quite complicated as a pulley or rigging "bull's eye" is required to be around the jib sheet to perform the actual deflection and then a second pulley or additional rigging "bull's eye" is required to redirect the in-hauler line back to the boat cockpit. This second pulley or rigging "bull's eye" for the in-hauler line must also be anchored to the vessel generally with some form of pad eye or other attached fitting. Furthermore, sometimes the tension required to pull on the in-hauler line becomes so great that a 2:1 or greater purchase system must additionally be implemented, which requires yet more attachment points and pulleys. Finally, in cases of more advanced racing, it may be desired to control the in-hauler not only by inward and outward motions, but also by athwartship motions as well so as to control multiple vector components of the direction of the pull on the deflected jib sheet. Such a multi-degree of freedom in-hauler is generally referred to as a barber hauler and requires the use of still more sets of pulleys, pad eyes and sometimes the implementation of translatable attachment points otherwise known as travelers, further adding to the complexity, expense and clutter on the sailboat deck.

There are still more locations on sailing vessels which require the use of both a pad eye and a method to redirect a line, with both operations required in the same approximate location. These locations include controlling the tack line on an asymmetrical spinnaker or controlling spinnaker sheets, with many instances requiring the redirection of the line by angles of typically 90 degrees. Finally, in some cases of more advanced rigging it may be of advantage to have both an anchor point such as a pad eye and also a method to redirect the angle of a line, with both modes of function located on another suspended line instead of constrained to a fixed surface. Such an arrangement can provide additional degrees of freedom for lead angle adjustments. However, for such suspended systems, the weight and bulk become important factors as to the practicality of such an arrangement when using existing state-of-the-art solutions consisting of pad eyes and pulleys.

Prior art solutions to the issues presented generally involved using conventional pulleys and pad eyes or other connectors fastened to the deck or to a translatable attachment point such as a traveler. For many applications, it was previously not practical to consider the idea of replacing pulleys with fairleads as lines used with prior art solutions had much higher friction coefficients than the current state-of-the-art ultra-high molecular weight polyethylene lines of today. With the advent of such new line materials, the opportunity has been opened to simplify many of the conventional rigging systems on sailing vessels as well as the rigging systems for other fields of use such as the mining or arborist industries.

U.S. Pat. No. 6,321,674 issued to Whitmore discloses a device to act as a combination cleat and pad eye. The device consists of a traditional horned deck type rope cleat that also contains a pad eye ring which can be folded down when not in use. However, the device presents as a means of creating a pad eye for securing a rope such as used when attaching a vessel to a dock and not for the use with running rigging on a sailing vessel. The device does not address the concern of creating a pad eye that can also act as a fairlead for redirecting running rigging nor does it allow for both an isolated attachment point for a pad eye and a separate fairlead passage so as to prevent the two separate lines from rubbing into each other and causing wear or frictional losses.

U.S. Pat. No. 5,878,684 issued to Adams discloses another cleating device that can be used to secure lines and also act as a deadeye or fairlead. However, the device is again made with the purpose of securing lines such as would be required for securing a vessel to a dock. Like the Whitmore patent, the Adams device contains horns like a traditional dock cleat. Such horns would pose a snag hazard for passing sails or sheets on the working deck of a sailing vessel. In addition, the Adams device does not address the need for the redirection of lines as required for the operation of a jib sheet "in hauler". It also does not provide both an isolated attachment point for a pad eye and a separate fairlead passage so as to prevent the two separate lines from rubbing into each other.

U.S. Pat. No. 5,447,800 issued to Lawrence pertains to a combination dock cleat and chock and describes a device to secure a boat to a dock using two horizontally protruding horns. The Lawrence device aims to prevent injury to a person walking along a dock by providing additional sloping surfaces so as to shield the horizontally protruding horns of traditional cleats. The Lawrence device also does not address the need for the redirection of lines as required for the operation of a jib sheet "in hauler". Furthermore, the presented Lawrence device does not address a method of attaching a 2:1 purchase system as is sometimes required for "in haulers" on a sailboat, or for both an isolated attachment point for a pad eye type connection and a separate fairlead passage so as to prevent the two separate lines from detrimentally rubbing into each other.

U.S. Pat. No. 5,445,482 issued to Davis teaches of a cargo tie down device. The Davis device presents an embodiment that is generally too long and unwieldy to be mounted on the tight constraints of the working deck of a sailing vessel. The Davis patent addresses the need of a tie down for securing cargo on a truck or trailer but does not address the need of a fitting that can be used as both a pad eye and a fairlead, especially on sailing vessels where significant vertical to horizontal line redirection angles are required.

U.S. Pat. No. 5,261,343 issued to Elterman and Cohn teaches of another cleat for fastening line or rope. It presents a device with multiple V notches so as to wedge or secure lines. The Elterman patent presents a cleat that provides a means of easily attaching a line in a "figure eight winding" and more specifically it presents a device for users who may not be skilled in the method of "figure eight winding". The Elterman device does not address a means of presenting a fitting which can act as both a pad eye and as a fairlead simultaneously, nor as a way to redirect the direction of pull of lines from essentially vertical to essentially horizontal directions as is sometimes required on a sailing vessel. The Elterman device also fails to present an embodiment that can be used as with a 2:1 purchase system such as is sometimes needed for the "in hauler" of the jib sheet on a sailing vessel. Furthermore, the device does not address the need for a fitting that can be used as both a pad eye and a fairlead simultaneously and independently or of a method to isolate and prevent the two separate lines of different uses from rubbing into each other and causing wear and additional friction.

U.S. Pat. No. 4,352,336 issued to Tostado discloses an adjustable cleat. The Tostado patent presents a cleat whereas the spacing between its horns and its base is adjustable so as to allow for the clamping of lines of varying thicknesses. The Tostado patent does not present a device that can be used as a pad eye and fairlead simultaneously and independently nor does it present a means of redirecting lines from essentially vertical to essentially horizontal directions as is sometimes required on a sailing vessel. The Tostado patent mainly teaches of a way to cleat lines of varying thicknesses to a dock as would be used for the securing of a vessel.

U.S. Pat. No. 3,747,554 issued to Allen discloses a combination chock and fairlead fitting. The Allen device teaches of a low profile chock to prevent tripping hazards as well as to provide a more structurally sound mounting configuration over that of conventional homed dock cleats. The Allen patent presents a device that was designed to mount on the corner of a dock and not on a relatively flat surface such as a sailboat deck. In addition, the Allen device does not present a means of isolating a line such as used in a fairlead from an additional line permanently attached in the manner of a pad eye and thus has the drawback of enabling the two such lines to rub and chafe into each other. It further has the drawback of requiring a substantial hole to be cut into the side of the structure onto which it is to mounted onto, which would be a severe shortcoming for a sailboat or other vessel.

U.S. Pat. No. 10,322,918 issued to Tamme discloses a low friction sheave pulley with a U-shaped frame that can be used to redirect lines on a boat. However, the device does not present a means for it to be used as a pad eye, nor as a combination pad eye and fairlead. The device is designed to be a low friction replacement for a pulley block only.

The Italian manufacturer Antal of Padova, Italy (www.Antal.it) has developed and has marketed an unpatented pad eye that has a more generous radius for polyethylene lines, but such device contains only a small slot to attach the line. The Antal device does not present an embodiment to separate the location of two or more independent lines into isolated areas so as to prevent them from rubbing or chaffing into each other. Additionally, the Antal device does not provide for multiple attachment points and multiple fairlead passages which are sometimes needed for more advanced rigging applications. Finally, the Antal device presents an unsymmetrical shape that was not designed to be mirrored and joined to another such device so as to create a double pad eye and fairlead device assembly that can be attached to a line in a suspended location. The Antal device was designed to be attached to a fixed surface only and does not possess the multiple attachment points or multiple fairlead passages as would be required if it ever was suspended from a line.

SUMMARY

It is an aspect of the presented embodiments to provide an improved deck pad eye and fairlead device that can act as both an attachment point for a connected line and as a fairlead passage for an additional line simultaneously and independently.

It is another aspect of the presented embodiments to provide an improved pad eye and fairlead device that presents both an attachment point for a connected line and a fairlead passage for an additional line in a configuration that provides isolated regions between where a line is attached in a pad eye arrangement and where another line is redirected in a fairlead arrangement so as to prevent the lines from rubbing into each other and causing wear and additional friction.

It is another aspect of the presented embodiments to provide an improved pad eye and fairlead device that combines the features of both a traditional rigging "bull's eye" and the features of a traditional pad eye into one single compact fitting.

It is another aspect of the presented embodiments to provide an improved pad eye and fairlead device that provides multiple and isolated attachment points for lines to be attached to in a pad eye arrangement.

It is another aspect of the presented embodiments to provide an improved pad eye and fairlead device that provides multiple and isolated fairlead passages so that lines can be redirected to a number of different desired directions.

It is another aspect of the presented embodiments to provide an improved pad eye and fairlead device that can also be used as a less snag prone alternative to traditional horn shaped cleats.

It is another aspect of the presented embodiments to provide an improved pad eye and fairlead device containing an attachment eye component shaped as an annular ring with the direction of the diameter of the ring oriented in a plane that is either essentially parallel to the plane of the invention's mounting base or canted at a predetermined angle.

It is another aspect of the presented embodiments to provide an improved pad eye and fairlead device that is configured in a symmetrical configuration so that such device can be joined or mated to a second such device that is oriented in an inverted orientation so as to create a double pad eye and fairlead device assembly that can then be attached to a line in a suspended location instead of to a fixed surface.

It is another aspect of the presented embodiments to provide alternative embodiments of an improved pad eye and fairlead device so as to allow for one, two, three, four or other numbers of attachment points and fairlead passages so as to allow for more flexibility of different rigging options.

It is another aspect of the presented embodiments to provide alternative embodiments of an improved pad eye and fairlead device that may be comprised of two, three, four or other numbers of mounting legs to provide additional strength and stability as well as additional pad eye and fairlead locations.

It is another aspect of the presented embodiments to provide an improved pad eye and fairlead device that can be used to attach both lines made from fabric or other soft materials and also rigid hardware such as metal snap shackles or wire rope thimbles simultaneously and independently.

It is another aspect of the presented embodiments to provide an improved pad eye and fairlead device that can be used as a platform for implementing a 2:1 or multiple purchase system by using the pad eye feature of the device as a fixed attachment point and using the fairlead feature of the device to take the place of a pulley.

It is another aspect of the presented embodiments to provide an improved pad eye and fairlead device that has an internal entrance opening configured so as to allow a line to enter from essentially a vertical direction and have the option to exit in a plurality of different essentially horizontal directions or vice versa.

It is another aspect of the presented embodiments to provide an improved pad eye and fairlead device that allows the further redirecting of the lead angle of lines exiting or entering a fairlead passage of the device by using the sides of the mounting legs of the device as additional fairlead type redirection surfaces.

It is another aspect of the presented embodiments to provide an improved pad eye and fairlead device with the edges of the entrances and exits of the fairlead passages rounded and filleted to such predetermined dimensions so as to prevent chaffing or damage to ultra-high molecular weight polyethylene lines or other such line materials due to excessively sharp turning radii.

It is another aspect of the presented embodiments to provide an improved pad eye and fairlead device that is contoured so as to minimize the stubbing of toes, tripping of crew members, or snagging of sails or additional sheets that may be dragged over the device.

It is another aspect of the presented embodiments to provide an improved pad eye and fairlead device that utilizes a method of mounting that minimizes the reduction of the structural integrity of the surface that the device is mounted to.

It is another aspect of the presented embodiments to provide an improved pad eye and fairlead device that has bolt patterns essentially the same as that of existing traditional boat deck pad eyes so as to make retrofitting the unit easier.

It is another aspect of the presented embodiments to provide an improved pad eye and fairlead device that is contoured in a manner so as to not present an internal depression than could collect rainwater, ice, ocean spray or other debris.

It is another aspect of the presented embodiments to provide an improved pad eye and fairlead device that can be mounted on or made integral to a sailboat traveler car.

It is another aspect of the presented embodiments to provide an improved pad eye and fairlead device that is symmetrical in shape along at least one axis so that it can be more easily manufactured by using an extrusion process.

BRIEF DESCRIPTION OF THE DRAWINGS

FIG. 2A is a top view perspective of a second presented embodiment with a plane used to illustrate a canted orientation of the annular ring with respect to a fixed surface that the device is mounted to.

DETAILED DESCRIPTION OF THE PRESENTED EMBODIMENTS

Figure 1A:
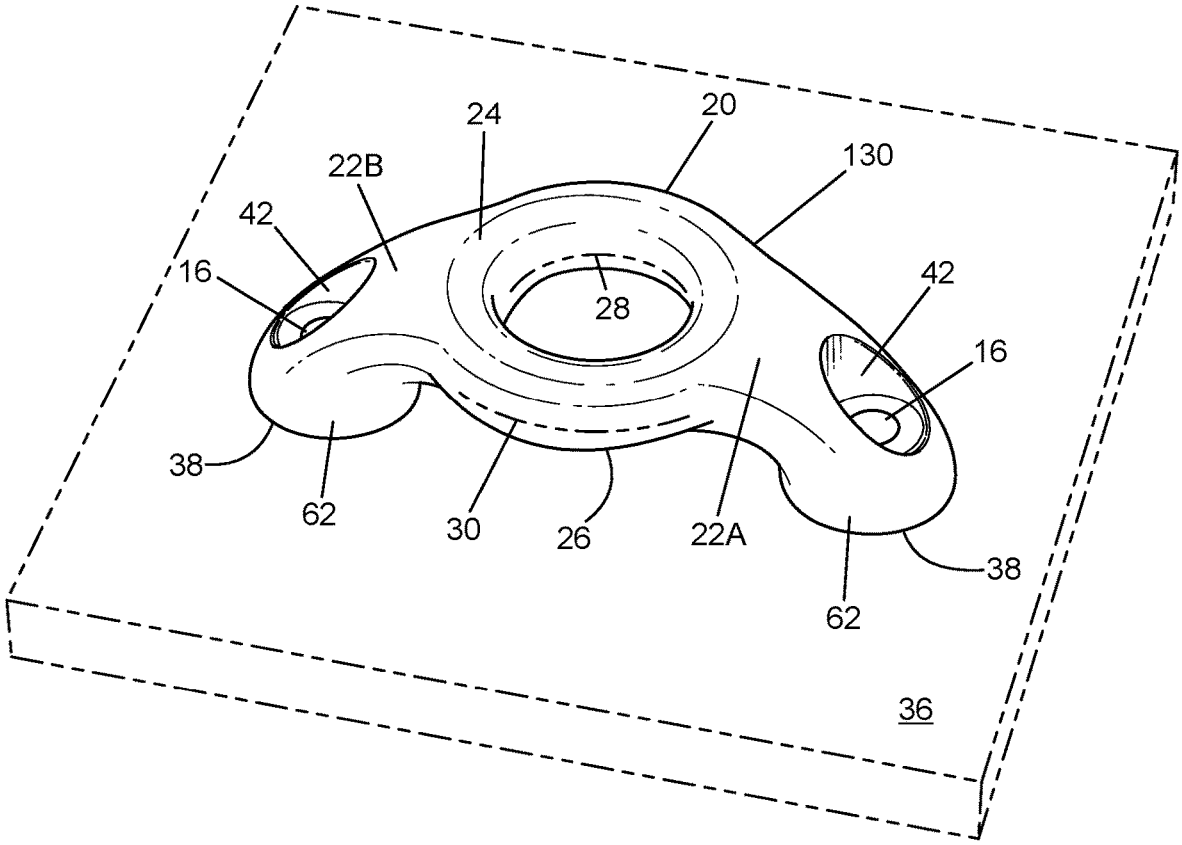
FIG. 1A is a top perspective view the first presented embodiment constructed in accordance with the invention, showing the upper half of the presented device.

FIG. 1A presents a perspective view of the first presented embodiment 130 of the device. The device consists of an annular ring 20 that has legs 22A and 22B protruding from the outside diameter 30 of annular ring 20. Annular ring 20 has both an outside diameter 30 and an inside diameter 28 and annular ring 20 is generally toroidal in shape. Annular ring 20 has a top side 24 facing in a direction defined as upward. Herein, directional terms such as "upward", "downward", "outward", "inward", "top", "bottom", "vertical", "horizontal" and "sides" refer to the presented embodiment(s) in an exemplary orientation and are not intended to limit the device to any particular orientation. Conversely, ring 20 has a bottom side 26 facing a direction defined as downward. Legs 22A and 22B protrude outward radially from the outer diameter 30 of ring 20 and then curve and bend downward toward a fixed surface 36. Fixed surface 36 may be a boat deck or other surface. Bases 62 of legs 22A and 22B each have an underside surface 38. Underside surfaces 38 of the bases 62 of legs 22A and 22B are generally located coplanar to each other so that all underside surfaces 38 can sit evenly on surface 36. However, the positions of underside surfaces 38 of bases 62 of legs 22A and 22B can alternatively be offset vertically from each other depending upon the irregularity of fixed surface 36. Legs 22A and 22B protruding from ring 20 are generally oriented so that they symmetrically oppose each other with respect to the center of annular ring 20 but can be staggered in different angular positions depending upon the application. Legs 22A and 22B are also generally mirror images of each other, but can have different geometries and attributes depending upon the specific application. Legs 22A and 22B can also contain mounting holes 16. Mounting holes 16 can be recessed into legs 22A and 22B with optional counterbores 42 to provide a more snag resistant geometry.

Figure 1B:
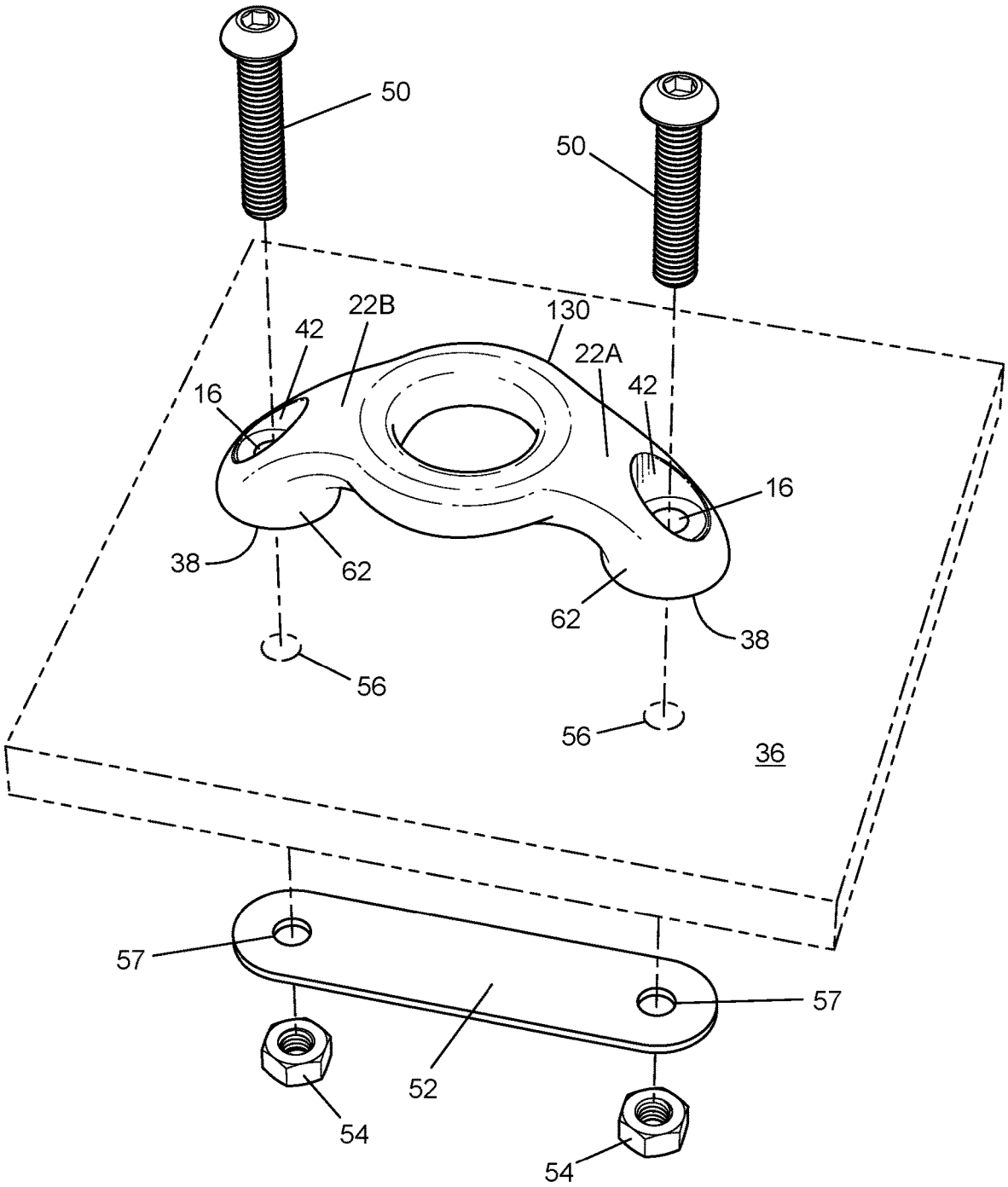
FIG. 1B is another top view perspective of the first presented embodiment further presenting an optional stiffening plate as well as mounting bolts that are inserted from the topside direction.

FIG. 1B presents a similar perspective view of embodiment 130 but with an optional stiffening plate 52 located underneath surface 36 so as to provide more support if rigidity is lacking in surface 36. Surface 36 becomes sandwiched between underside surfaces 38 of bases 62 of legs 22A and 22B and stiffening plate 52. Bolts 50 can be inserted through counterbores 42 and mounting holes 16 of legs 22A and 22B and passed through both the holes 56 of surface 36 and the holes 57 of optional stiffening plate 52 and then secured with nuts 54. It is understood that stiffening plate 52 is not limited for use with only embodiment 130 but can also be shaped differently and can be used with other presented embodiments as well.

Figure 1C:
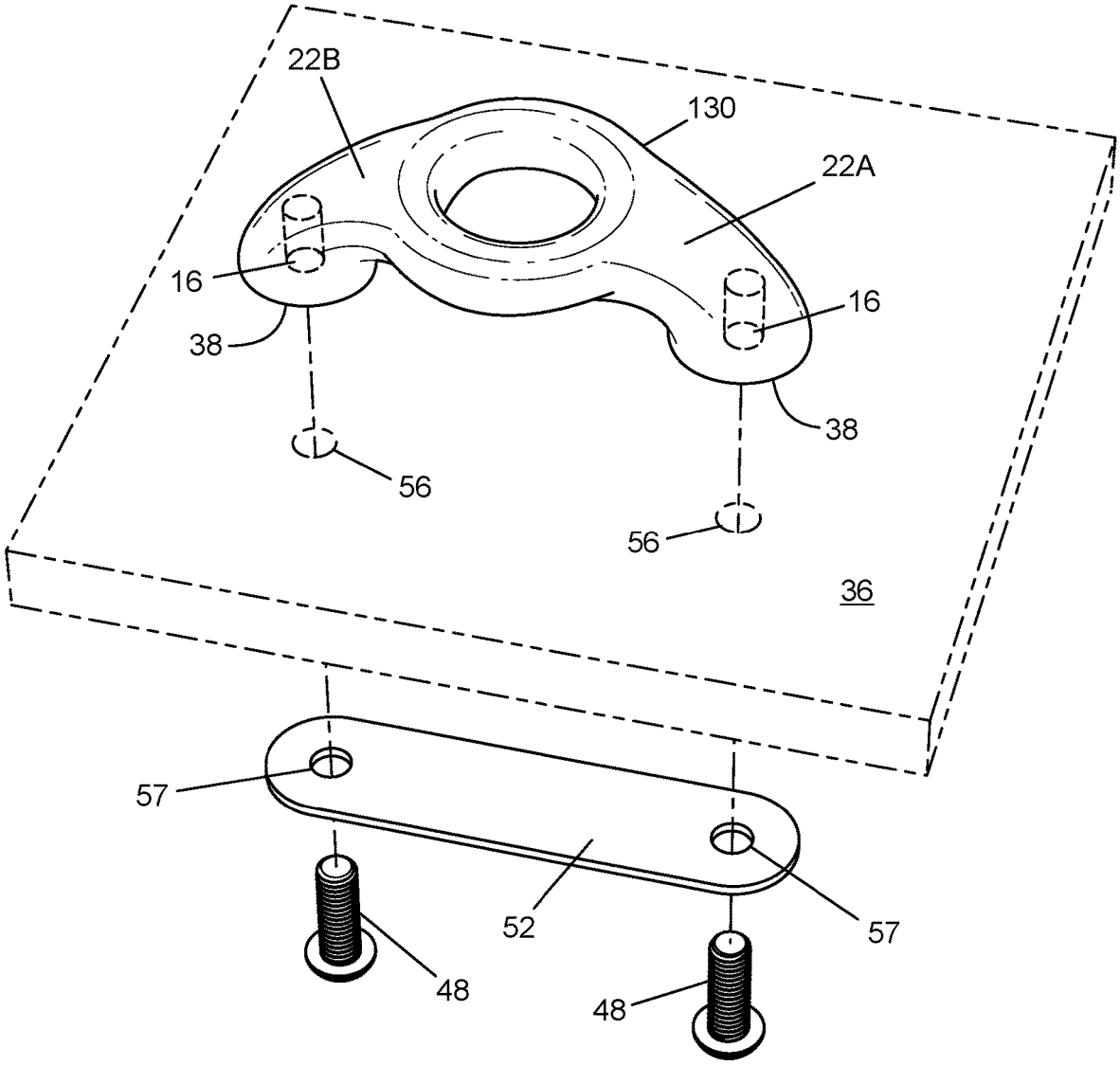
FIG. 1C is a top view perspective of the first presented embodiment similar to that as was shown in FIG. 1B but with mounting bolts inserted from the bottom direction.

FIG. 1C presents a similar perspective view of the embodiment 130, but with optional bolts 48 inserted from the underside direction of surface 36 instead of inserted from the topside direction of surface 36. Mounting holes 16 originating from underside surfaces 38 of legs 22A and 22B can comprise of blind holes or through holes and can be smooth bored or internally threaded to accept threaded bolts 48 from such underside direction. Bolts 48 can be inserted through holes 57 of stiffening plate 52, passed through holes 56 of surface 36 and then threaded into mounting holes 16 of legs 22A and 22B. It is understood that other means of attachment of embodiment 130 to fixed surface 36 are also possible, as well as other means of attachment of additionally presented embodiments to other additionally presented surfaces.

Figure 1D:
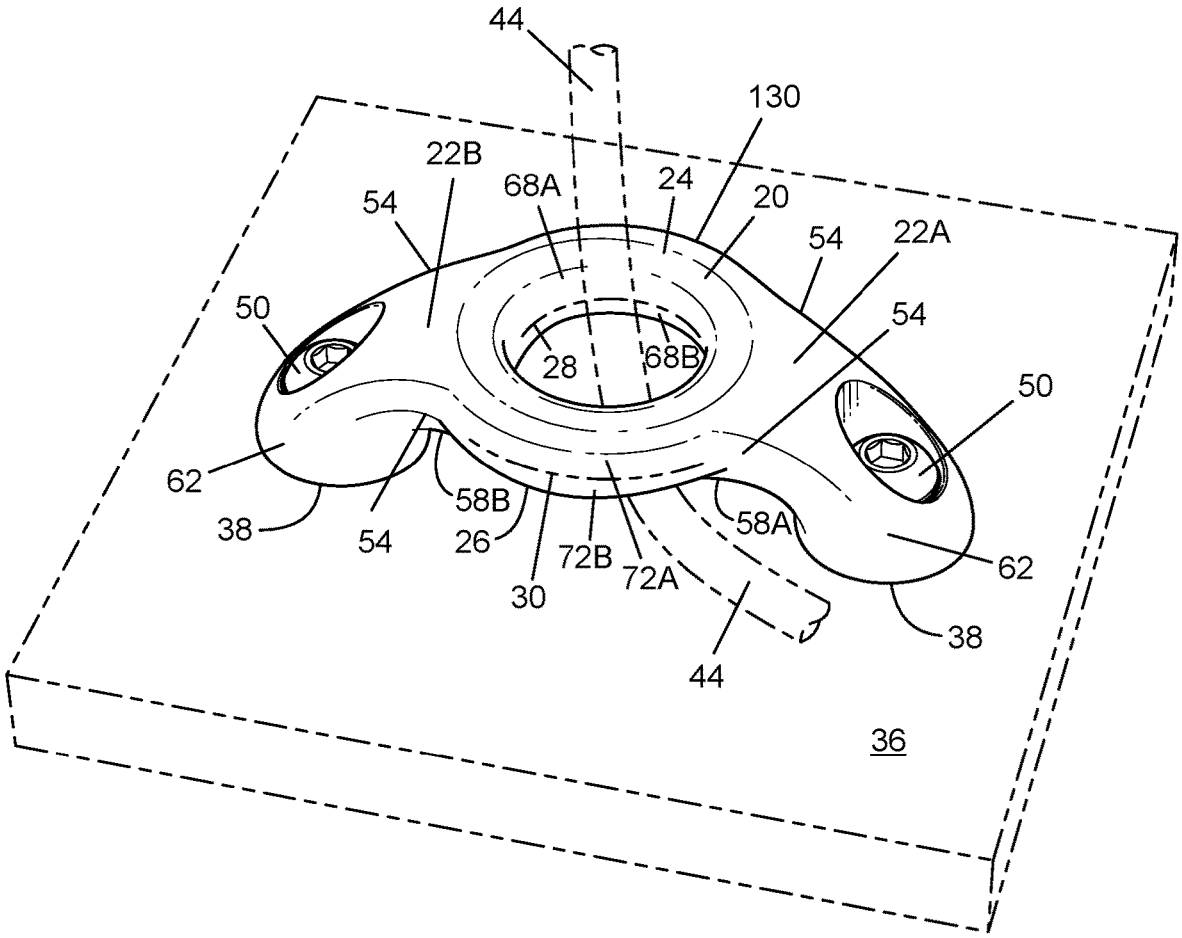
FIG. 1D is another top view perspective of the first presented embodiment further presenting the annular ring, the configuration of the legs and fillets, and an illustration of a line being deflected by the device to demonstrate its operation as a fairlead.

FIG. 1D presents another perspective view of the first presented embodiment 130 mounted to a fixed surface 36 with the use of bolts 50. FIG. 1D demonstrates how legs 22A and 22B bend downward enough below the bottom side 26 of ring 20 so that a rope or line 44, or alternatively multiple ropes or lines 44, can fit through the gap created between the bottom side 26 of ring 20 and the top surface of fixed surface 36 onto which the underside surfaces 38 of the bases 62 of legs 22A and 22B are mounted to. Although there is no set limit for the inside diameter 28 of ring 20, inside diameter 28 is generally made large enough to allow for two or more diameters of line 44 to pass through without interfering with each other. There is also no set limit for the outside diameter 30 of ring 20, but outside diameter 30 is generally large enough to provide a radial thickness of ring 20 of dimensions to allow for the construction of rounded edges 68A and 68B on the inside diameter 28 and rounded edges 72A and 72B on the outside diameter 30 of ring 20 to be formed to predetermined sizes so as to act as fairlead surfaces to redirect the direction of line 44. Consequently, the axial thickness of ring 20 is also generally of a dimension so as to allow for the similar construction of rounded edges 68A and 68B on the inside diameter 28 and rounded edges 72A and 72B on the outside diameter 30 of ring 20 to be formed to predetermined sizes so as to act as fairlead surfaces to redirect the direction of line 44. The radial thickness of ring 20 is defined as half the difference between outside diameter 30 and inside diameter 28 while the axial thickness of ring 20 is defined as the distance between the greatest vertical projection of the top side surface 24 with that of a corresponding greatest vertical projection of bottom side surface 26 in the opposing direction. The rounded edges 68A, 68B, 72A and 72B are made to predetermined dimensions based on the material characteristics of the particular line 44 used so as to prevent damage to the line 44 material from bending at too sharp of a radius. Rounded edge 68A is a round formed with the intersection of a plane created from the top surface 24 with the projected wall of the axial bore of the inside diameter 28 of ring 20, and rounded edge 68B is a round formed with the intersection of a plane created from the bottom surface 26 with the projected wall of the axial bore of the inside diameter 28 of ring 20. Rounded edges 68A and 68B are generally made of the same dimensions as each other but do not necessarily need to be the same. Consequently rounded edge 72A is a round formed on the intersection of a plane created from the top surface 24 with the projected wall made from projecting an axial cylinder created around the circumference of outside diameter 30 of ring 20, and rounded edge 72B is a round formed on the intersection of a plane created from the bottom surface 26 with the projected wall made from projecting an axial cylinder around the circumference of outside diameter 30 of ring 20. Rounded edges 72A and 72B are again generally made of the same dimensions as each other, but do not necessarily need to be the same. The dimensions of rounded edges 68A and 68B are generally, but not necessarily, of the same dimensions as rounded edges 72A and 72B respectively. Legs 22A and 22B merge with the outside diameter 30 of ring 20 in a contiguous manner with generally smooth and flowing transitions 54 in all directions of such merge so as create a snag free fairlead surface and to prevent other undesirable attributes created from sharp corners or irregular transitions. Fillet 58A and fillet 58B are formed on legs 22A and 22B respectively where legs 22A and 22B merge with the bottom surface 26 of ring 20 and transition with the outside diameter 30 of ring 20 so as to further provide contiguous smooth and flowing transitions. In addition, in this first presented embodiment 130 as well as in others, the outside geometries of bases 62 of legs 22A and 22B are made generally circular with respect to a plane parallel to underside surfaces 38 so as to provide rounded surfaces on the sides of the bases 62 of legs 22A and 22B of predetermined radii that are capable of acting as additional turning fairleads for line 44.

Figure 1E:
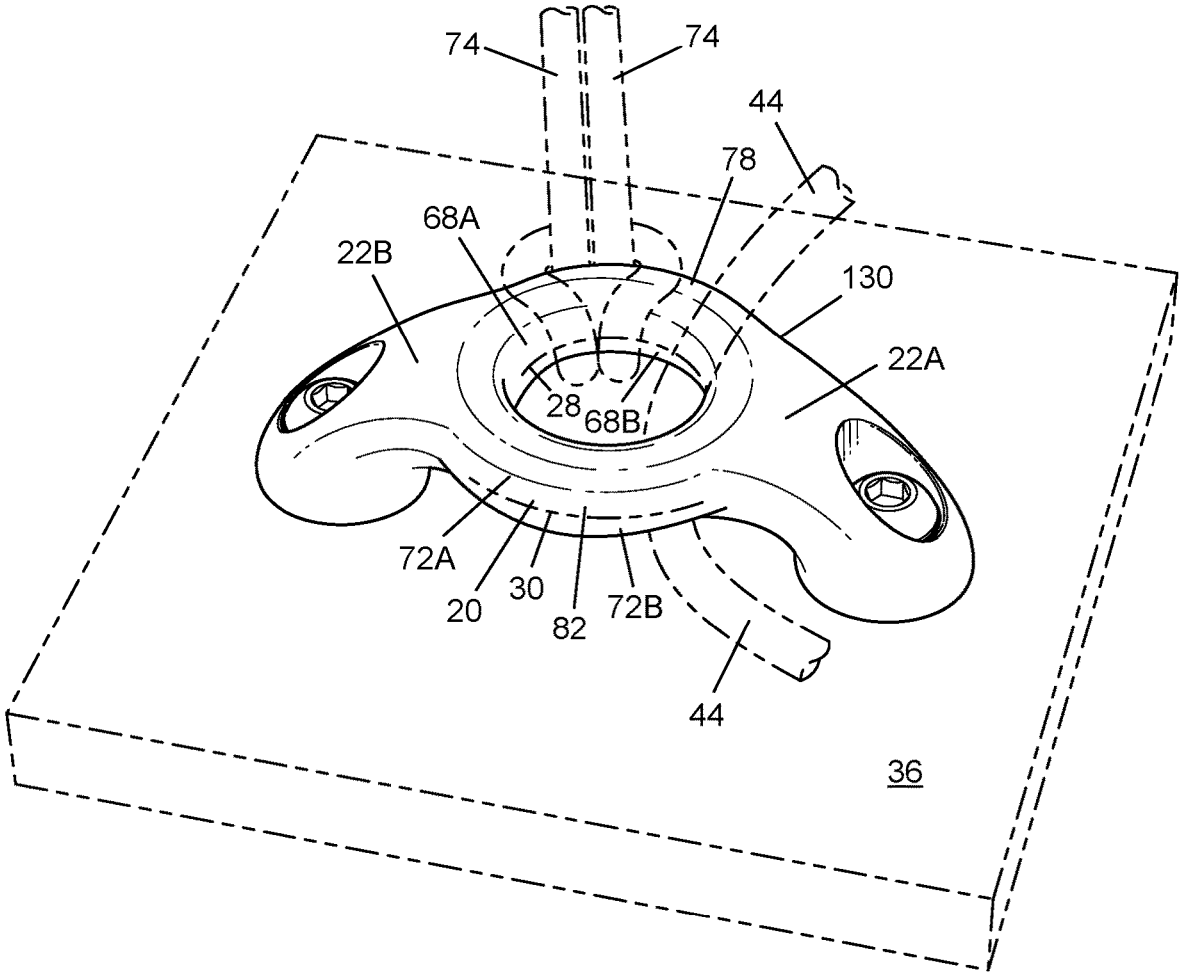
FIG. 1E is another top view perspective of the first presented embodiment illustrating how the device can be simultaneously used as both a pad eye and a fairlead in a manner that helps separate the lines from the two uses from rubbing into each other.

FIG. 1E further illustrates embodiment 130 mounted to surface 36 and demonstrates how line 74 can be attached to ring 20 in an attachment mode representing a fixed pad eye while line 44 can be simultaneously fed through the inner diameter 28 of ring 20 in an arrangement representing a fairlead. Line 74 can be attached to ring 20 using a "cow hitch" type connection, a standard knot or any other means of attachment depending upon the application. Region 78 defines the section of ring 20 that lies between adjacent legs 22A and 22B. Line 74 is constrained to stay in region 78 due to legs 22A and 22B acting as physical barriers to restrict any further movement of line 74 in a direction tangent to the circumference of outside diameter 30 of ring 20. Likewise region 82 defines another section of ring 20 that lies between adjacent legs 22A and 22B but on the opposing side of ring 20. Line 44 is constrained to stay in region 82 due to legs 22A and 22B again acting as physical barriers to restrict any further movement of line 44 beyond region 82 in a direction tangent to the circumference of outside diameter 30 of ring 20. As a result of these separate and isolated regions 78 and 82, lines 74 and 44 are generally restricted in their opportunity to be able to slide into and rub against each other whereas such interference could cause wear and additional friction. FIG. 1E also further illustrates how ring 20 contains rounded inside edges 68A and 68B as well as rounded outside edges 72A and 72B to provide round and gentle surfaces to act as a contact area for an attachment point or to act as fairlead turning surfaces for lines 74 or 44. The radii of rounded edges 68A, 68B, 72A and 72B are predetermined in size from the characteristics of the line material used, but generally range from one to as much as three times the radius of the line 44 or 74. In some cases, especially in situations of intermittent motion or light loading, the radii of rounded edges 68A, 68B, 72A and 72B can be smaller than the radius of the line 44 or 74. Generally the dimensional sizes of the radius of both rounded edges 68A, 68B, 72A and 72B are all made the same as each other but in some applications it may be desired to have outside rounded edges 72A and 72B smaller than the respective inside rounded edges 68A and 68B or vise versa so as to increase the cross sectional area of ring 20 for increased strength.

Figure 1F:
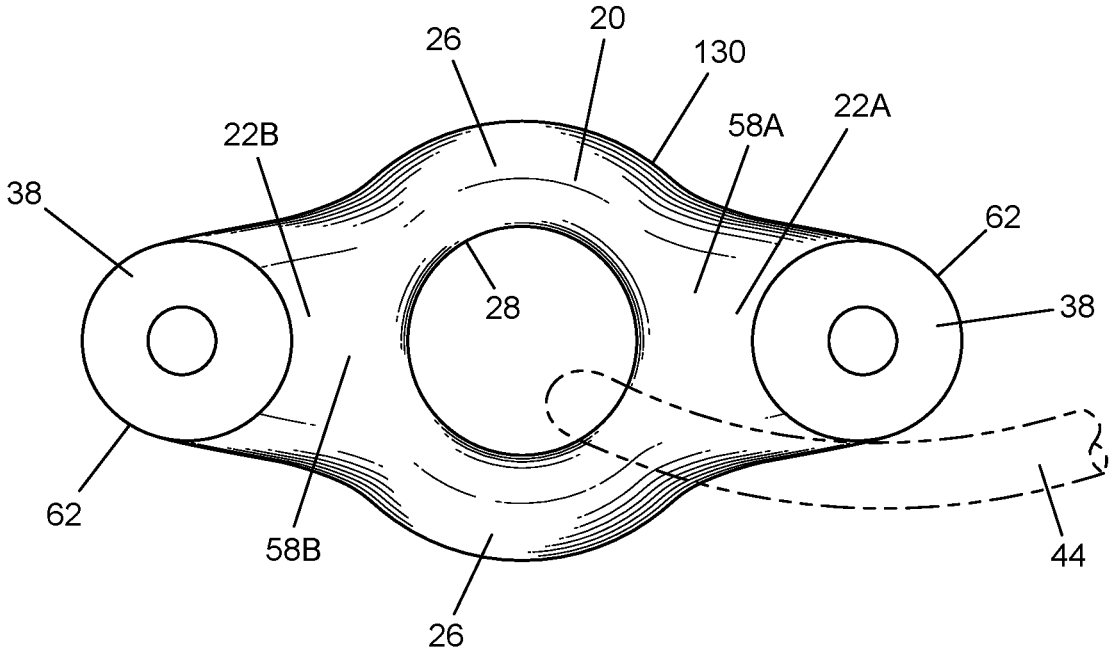
FIG. 1F is a bottom view of the first presented embodiment which further shows how surfaces on the sides of the bases of the legs of the device can be used as additional fairleads for further redirecting a line.

FIG. 1F displays the first presented embodiment 130 in a bottom view. FIG. 1F further illustrates that bases 62 of legs 22A and 22B generally present round projections onto the bottom plane created by underside surfaces 38 so as to act as additional redirect fairleads for further redirecting line 44 through additional turning angles. Fillet 58A between leg 22A and the bottom surface 26 of ring 20 as well as fillet 58B between leg 22B and the bottom surface 26 of ring 20 provide for a smooth and gradual transition for line 44 to pass over if line 44 exits from inside diameter 28 of ring 20 in the proximity of either one of legs 22A or 22B and impinges onto the sides of such legs 22A or 22B.

Figure 2A:
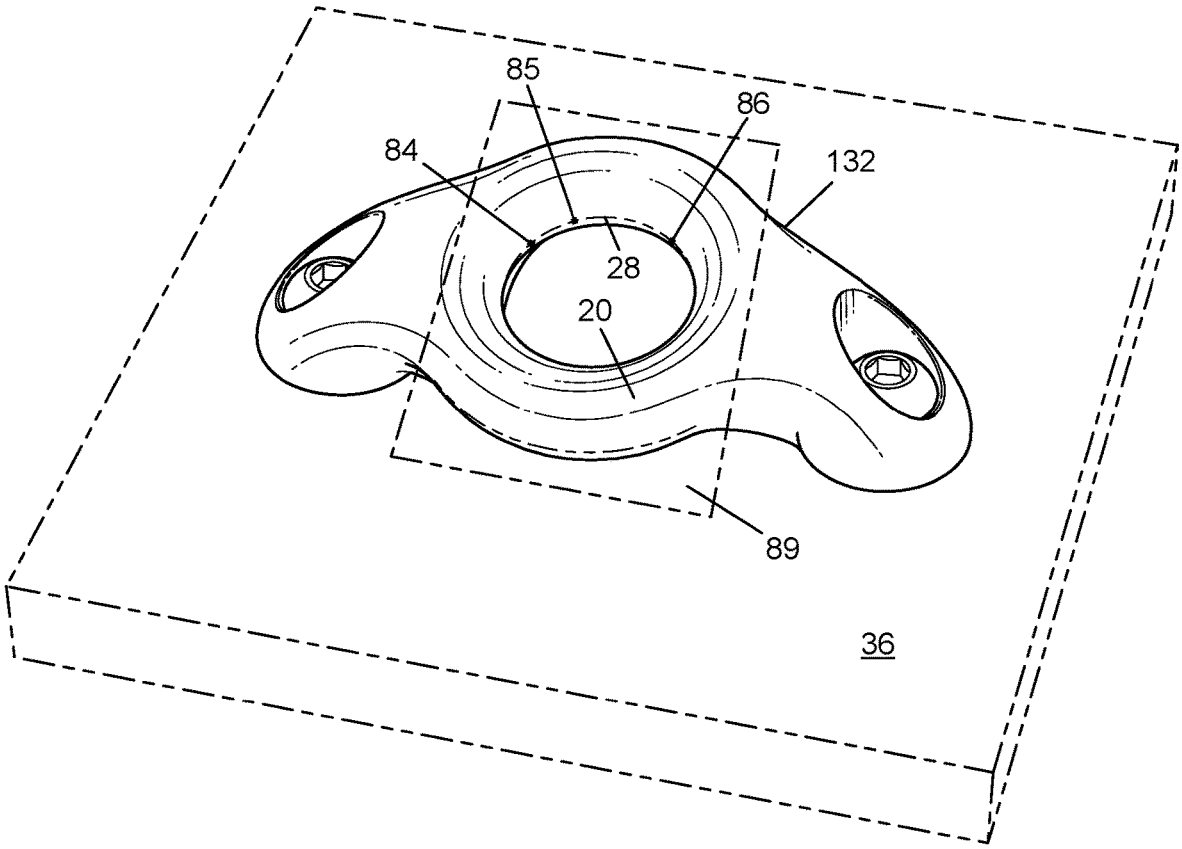

FIG. 2A is a top view perspective of a second presented embodiment 132 in which the annular ring 20 is in a canted orientation with respect to the fixed surface 36 onto which such presented embodiment is mounted to. A reference plane 89 defines the canted orientation of ring 20 with respect to fixed surface 36 and is formed by any three independent points 84, 85 and 86 located on the inside diameter 28 of ring 20. For certain rigging applications, canting the orientation of ring 20 with respect to the surface 36 onto which embodiment 132 is mounted to provides additional room on one side of the embodiment for the connection of larger rigid fittings, thimbles or other uses while maintaining or reducing the projected distance of ring 20 on the opposing side above surface 36 to reduce snag hazards. The degree of canting between plane 89 and fixed surface 36 depends upon the particular application but is generally about 15 degrees for the more common optional applications.

Figure 2B:
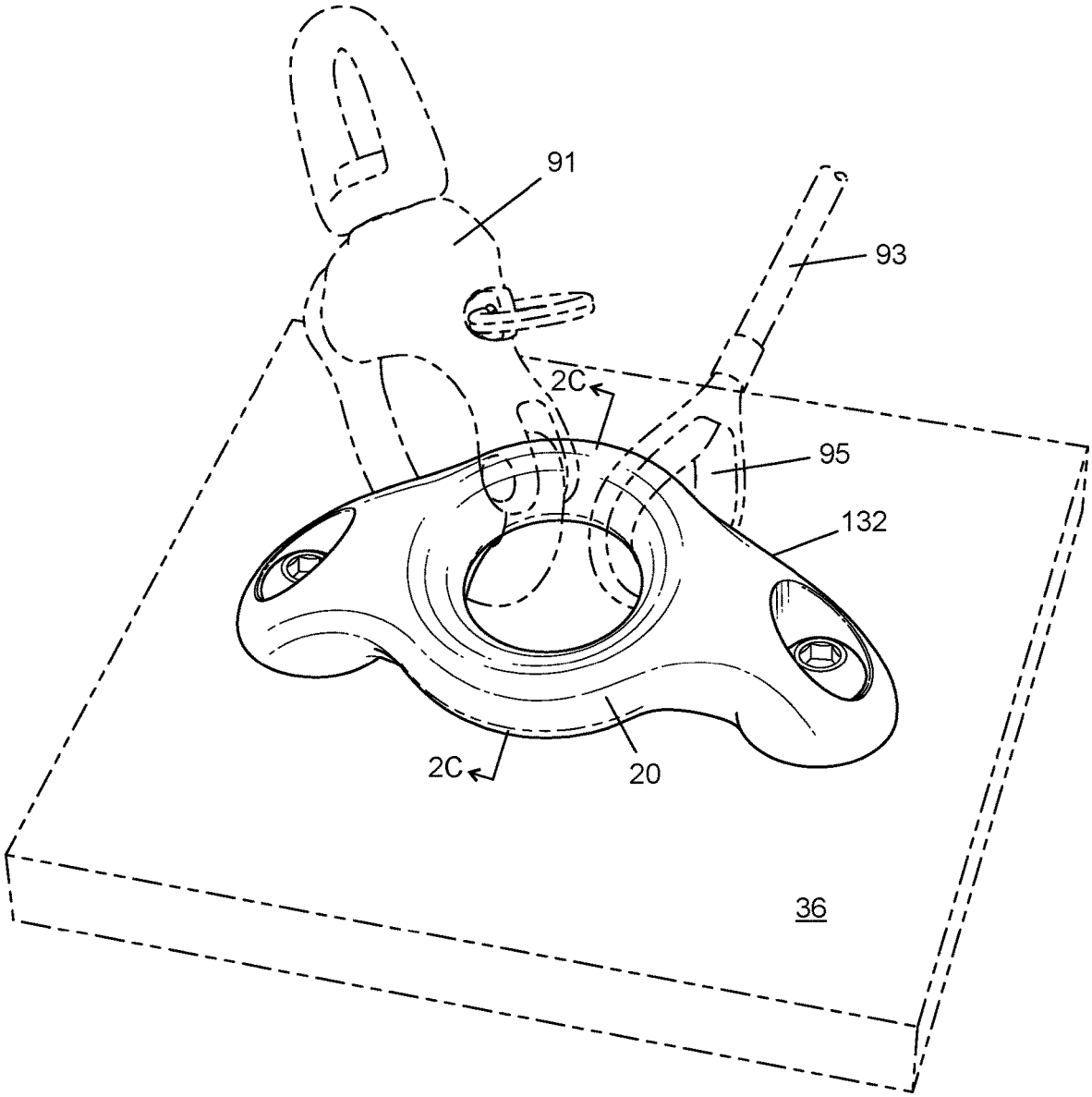
FIG. 2B is another perspective view of the second presented embodiment illustrating connections of rigid hardware to the device such as a shackle or wire rope. A sectional cut line 2C-2C is also shown on the figure.

FIG. 2B is a similar top view perspective of a second presented embodiment 132 in which the annular ring is in a canted orientation with respect to a mounting surface 36. The canted orientation provides additional clearance between the underside of annular ring 20 and the mounting surface 36 to allow for attaching items that may be larger than a line such as a typical rigid metal shackle 91 or a typical line or wire rope 93 implementing a typical rigging thimble 95. Sectional cut 2C-2C is also shown and is later presented in FIG. 2C.

Figure 2C:
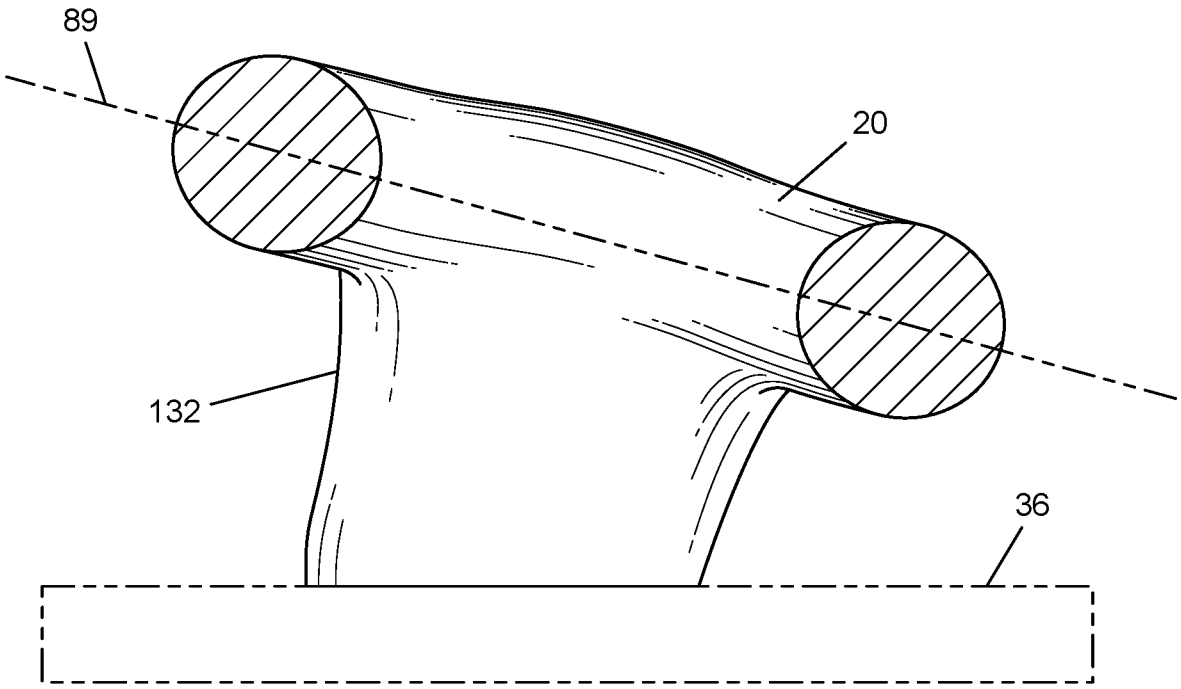
FIG. 2C is a cross sectional perspective view of the second presented embodiment as cut through the sectional line 2C-2C as was displayed in previous FIG. 2B.

FIG. 2C is a cross sectional view 2C-2C of the second presented embodiment 132 which further illustrates the canted orientation of the annular ring 20 with respect to the surface 36 onto which embodiment 132 is mounted to. A side view of plane 89 is further illustrated to present the canting of annular ring 20 with respect to mounting surface 36.

Figure 3:
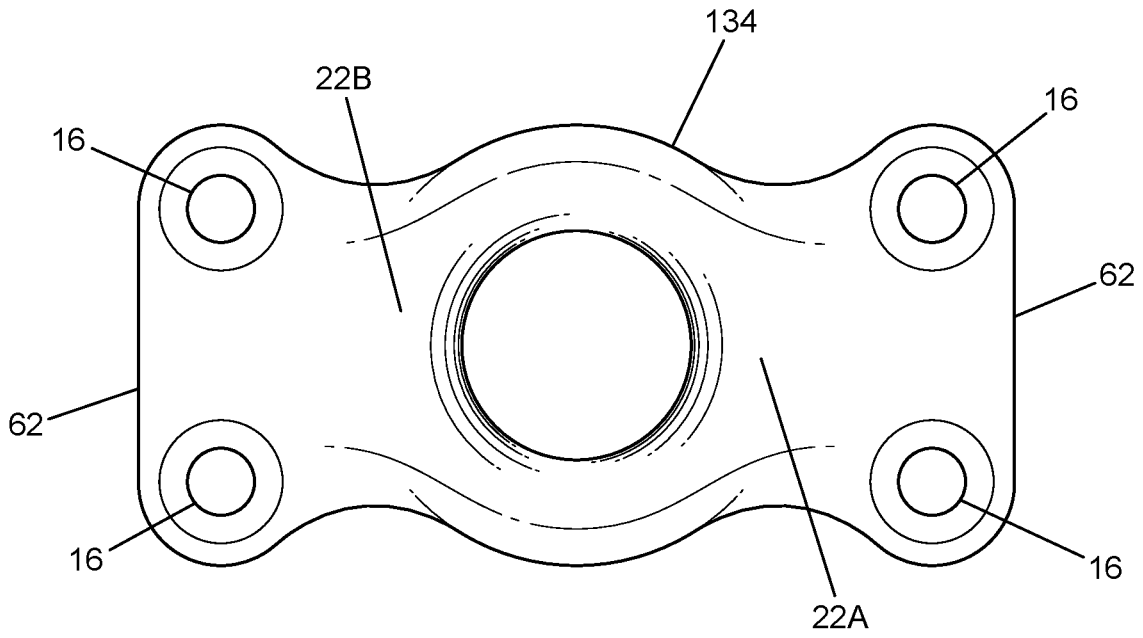
FIG. 3 is a top view perspective of a third presented embodiment illustrating wider legs with multiple mounting holes.

FIG. 3 displays a top view of a third presented embodiment 134. Embodiment 134 presents bases 62 of legs 22A and 22B widened so as to provide more stability and also provides more space to include a multitude of mounting holes 16. It is understood from previous FIG. 1B and FIG. 1C that embodiment 134 can also consist of holes 16 originating from the top side of legs 22A and 22B with countersinks 42, or comprise of blind holes originating from the bottom side of legs 22A and 22B, with said holes being either smoothly bored or internally threaded, among other options.

Figure 4:
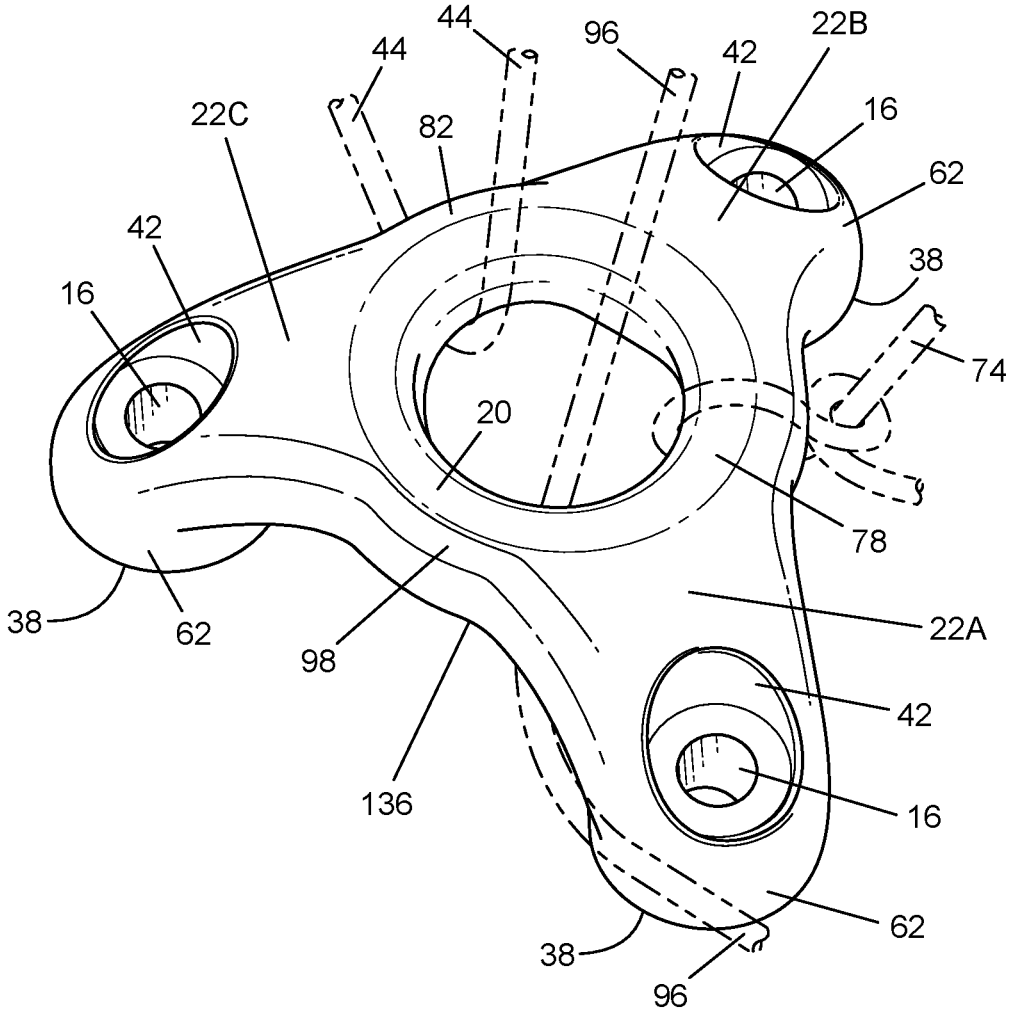
FIG. 4 is a top perspective view of a fourth presented embodiment of the device in a configuration utilizing three legs and illustrating lines attached to demonstrate a pad eye operation as well as lines redirected to demonstrate a fairlead operation.

FIG. 4 displays a fourth presented embodiment 136 which contains three legs 22A, 22B and 22C protruding from ring 20 to provide extra stability and more locations for attaching lines or components in a pad eye configuration and for providing more passages to be used in a fairlead configuration. Region 78 consists of the section of ring 20 located between its transitions with leg 22A and leg 22B. Region 82 consists of the section of ring 20 located between its transitions with leg 22B and leg 22C, while region 98 consists of the section of ring 20 located between its transitions with leg 22A and leg 22C. Each of the regions 78, 82 and 98 can act as either a location for attaching a line or other rigging component in a pad eye arrangement, or as a location for redirecting a line in a fairlead arrangement. Line 74 is shown attached in a pad eye arrangement to the presented embodiment 136 in region 78 but could also be attached in region 82 and/or in region 98. The presented embodiment 136 portrays line 44 being redirected in region 82 in a fairlead arrangement and line 96 being redirected in region 98 in another fairlead arrangement, with the side of base 62 of leg 22A acting as an additional means of line redirect. It is understood that any such regions 78, 82 and 98 can be used for either pad eye type attachment locations or as fairlead locations, and the sides of the bases 62 of any legs 22A, 22B or 22C can also be used as an additional means of line redirection. Embodiment 136 also contains mounting holes 16. It is understood from previous FIG. 1B and FIG. 1C that embodiment 136 can also consist of holes 16 originating from the topside of legs 22A, 22B and 22C with counterbores 42, or comprise of blind holes originating from the underside surfaces 38 of legs 22A, 22B and 22C, with said holes being smoothly bored or internally threaded, among other mounting options.

Figure 5:
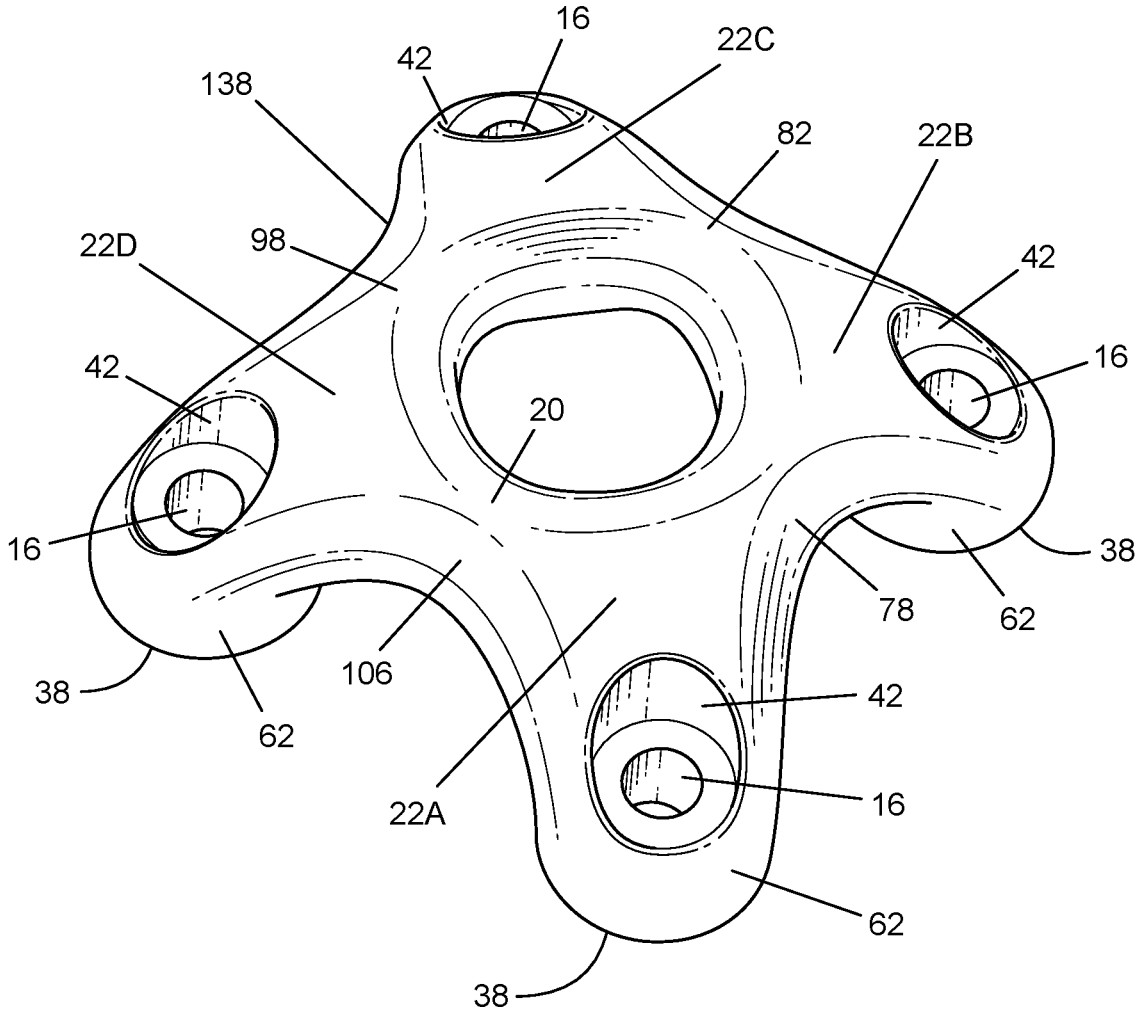
FIG. 5 is a top perspective view of a fifth presented embodiment of the device in a configuration utilizing four legs.

FIG. 5 displays a fifth presented embodiment 138 which contains four legs 22A, 22B, 22C and 22D protruding from ring 20 to provide yet more extra stability and more locations for pad eye type attachment points or fairlead passages. Region 78 consists of the section of ring 20 located between its transitions with leg 22A and leg 22B. Region 82 consists of the section of ring 20 located between its transitions with leg 22B and leg 22C. Region 98 consists of the section of ring 20 located between its transitions with leg 22C and leg 22D and region 106 consists of the section of ring 20 between leg 22D and leg 22A. Each of the regions 78, 82 and 98 and 106 can act as either a pad eye type attachment location or as a fairlead passage, and the sides of bases 62 of any leg 22A, 22B, 22C or 22D can be used as an additional means of line redirection. Embodiment 138 also contains mounting holes 16. It is understood from previous FIG. 1B and FIG. 1C that embodiment 136 can also consist of holes 16 originating from the topside of legs 22A, 22B, 22C and 22D with counterbores 42, or comprise of blind holes originating from the underside surfaces 38 of legs 22A, 22B, 22C and 22D, with said holes being smoothly bored or internally threaded, among other mounting options.

Figure 6A:
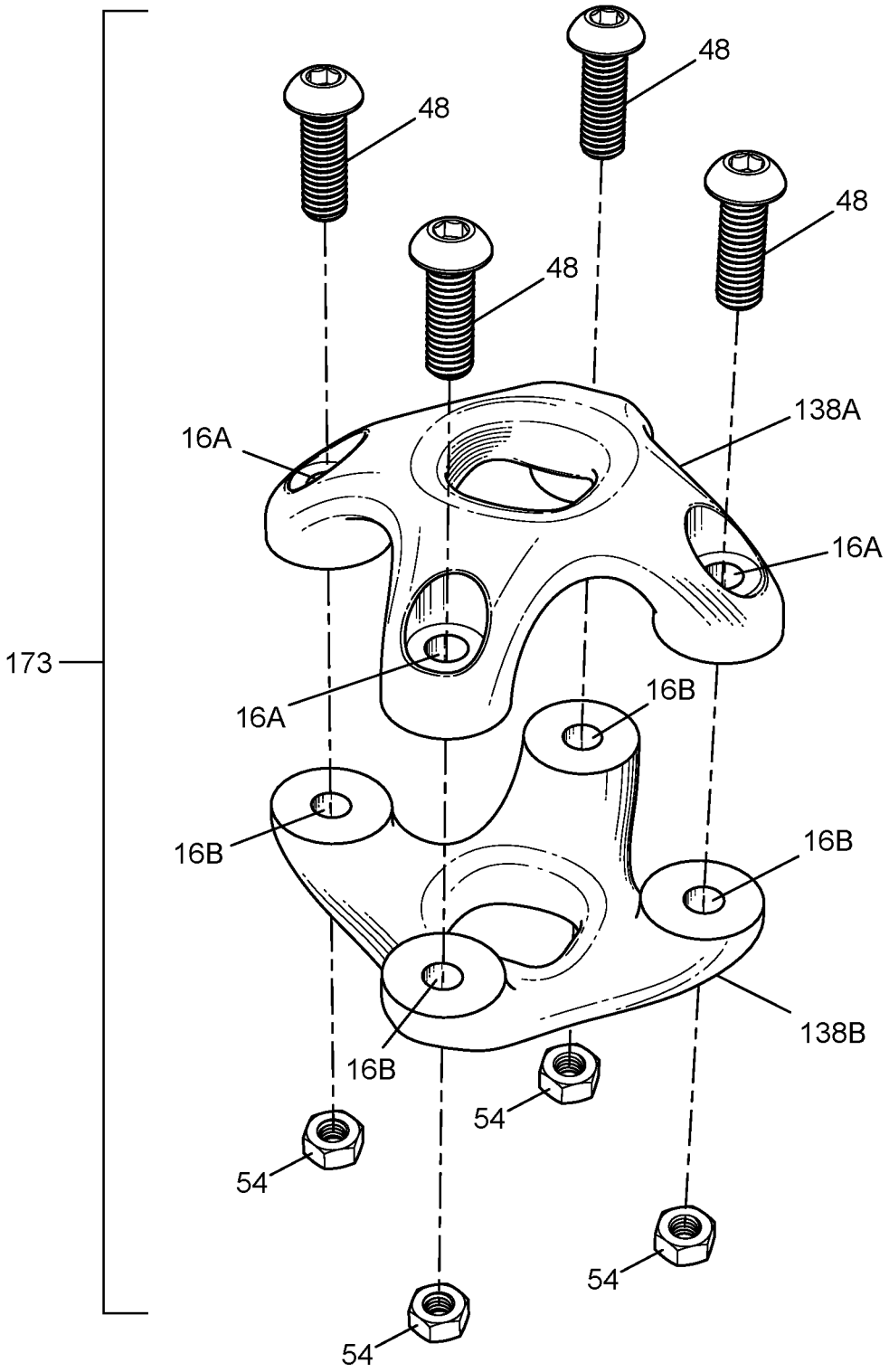
FIG. 6A is an exploded view of a sixth presented embodiment of the device in a configuration illustrating how two of the presented devices can be joined or mated together to form an assembly.

FIG. 6A displays an exploded perspective view of a sixth presented embodiment assembly 173 in which two of the presented embodiments 138 from FIG. 5 are employed. One such embodiment shown in an upright orientation is now referred to as 138A and a second such embodiment shown oriented in an inverted orientation relative to 138A is now referred to as 138B. Mounting holes 16A and 16B align which each other and bolts or screws 48 can be used to join embodiments 138A and 138B together with each other, among other means of fastening or joining. Mounting holes 16A and 16B can contain counterbores 42 and can employ nuts 54 on the threaded ends of bolts or screws 48, or alternately one such embodiment 138A or 138B can contain a through hole 16A or 16B, and the mating embodiment 138B or 138A can contain blind and threaded holes 16B or 16A to accept the threads of bolts or screws 48, among other fastening or joining options. The joined embodiment assembly 173 is no longer confined to be mounted to a fixed surface can now be attached to a line as anchor point and act as a suspended fairlead and/or as an additional suspended pad eye. It is understood that the previously presented embodiments 130, 132, 134 and 136 from earlier figures, or any other presented embodiment, could also be joined together with another such second similar but inverted embodiment in this same connection manner to form a similarly joined assembly. It is also understood that other presented embodiments in the upright and inverted positions could additionally be joined together other means of attachment such as, but not limited to, glue, welding, riveting, or other such joining means, as well as both the upright and inverted embodiment formed as one single combined component using casting, molding, forging, machining or other manufacturing techniques.

Figure 6B:
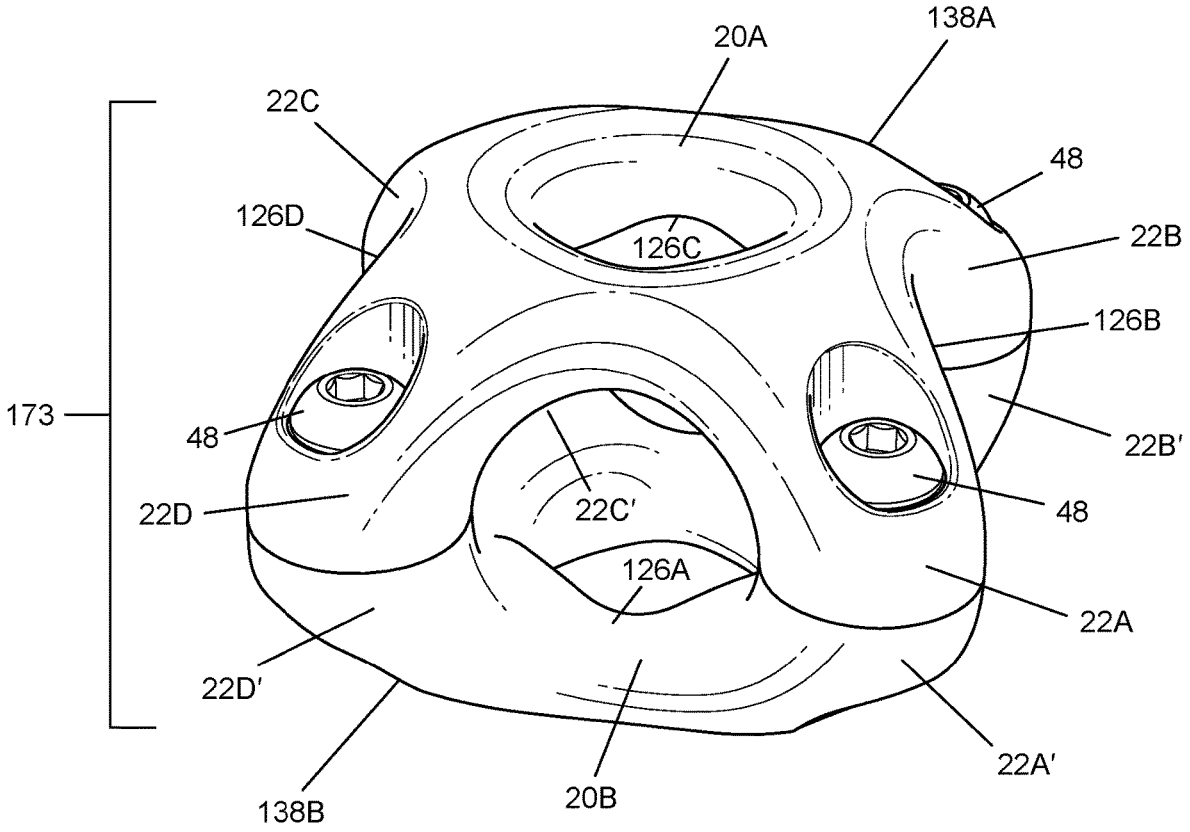
FIG. 6B is a top perspective view of the sixth presented embodiment shown in a fully joined assembly configuration.

FIG. 6B displays a perspective view of the sixth presented embodiment assembly 173 with embodiments 138A and 138B joined together with bolts 48. Ring 20A of embodiment 138A and ring 20B of embodiment 138B can each act as an attachment point or as a fairlead passage while side passage 126A between adjacent leg pairs 22D and 22D' and 22A and 22A' can also act as an attachment point or as a fairlead passage. Additional attachment points or fairlead type passages 126B, 126C and 126D are created between leg pairs 22A and 22A' and 22B and 22B', 22B and 22B' and 22C and 22C', as well as between and 22C and 22C' and 22D and 22D' respectively and are also illustrated in FIG. 6C.

Figure 6C:
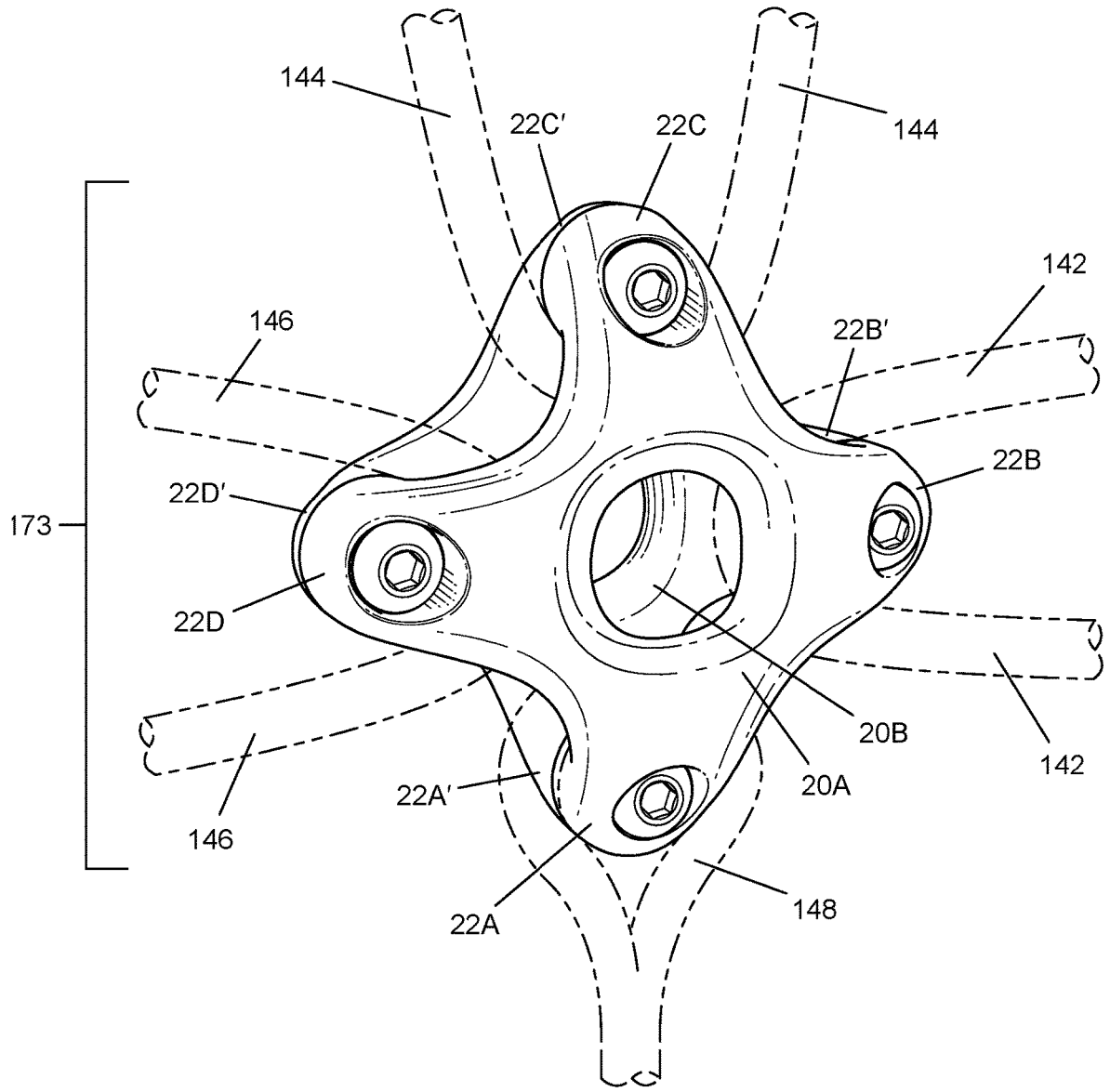
FIG. 6C is another perspective view of the sixth presented embodiment illustrating how the device in its fully joined assembly configuration can be attached to a line in a suspended location instead of being restrained to be mounted only to a fixed surface, and also perform as a fairlead for other additional lines.

FIG. 6C displays another perspective view of the sixth presented embodiment assembly 173 displaying one particular configuration with line 142 redirected around joined leg pairs 22B and 22B', line 144 redirected around joined leg pairs 22C and 22C', and line 146 redirected around joined leg pairs 22D and 22D'. Line 148 is shown spliced around joined leg pairs 22A and 22A'. In such a presented configuration, embodiment 173 acts as both a pad eye type attachment point and also as a fairlead, but the embodiment 173 can now be attached and located in a suspended location and is no longer confined to be mounted to a fixed surface. Additional lines can be attached to, or run as fairleads through, rings 20A and/or 20B. Lines attached or run as fairleads can also be configured in a multitude of different configurations or arrangements and are not limited to this single presented example. It is understood that embodiments 130, 132, 134, 136 from previous figures, or from any other presented embodiment, can also be joined together using the same presented methods and utilized for the same presented functions.

Figure 7A:
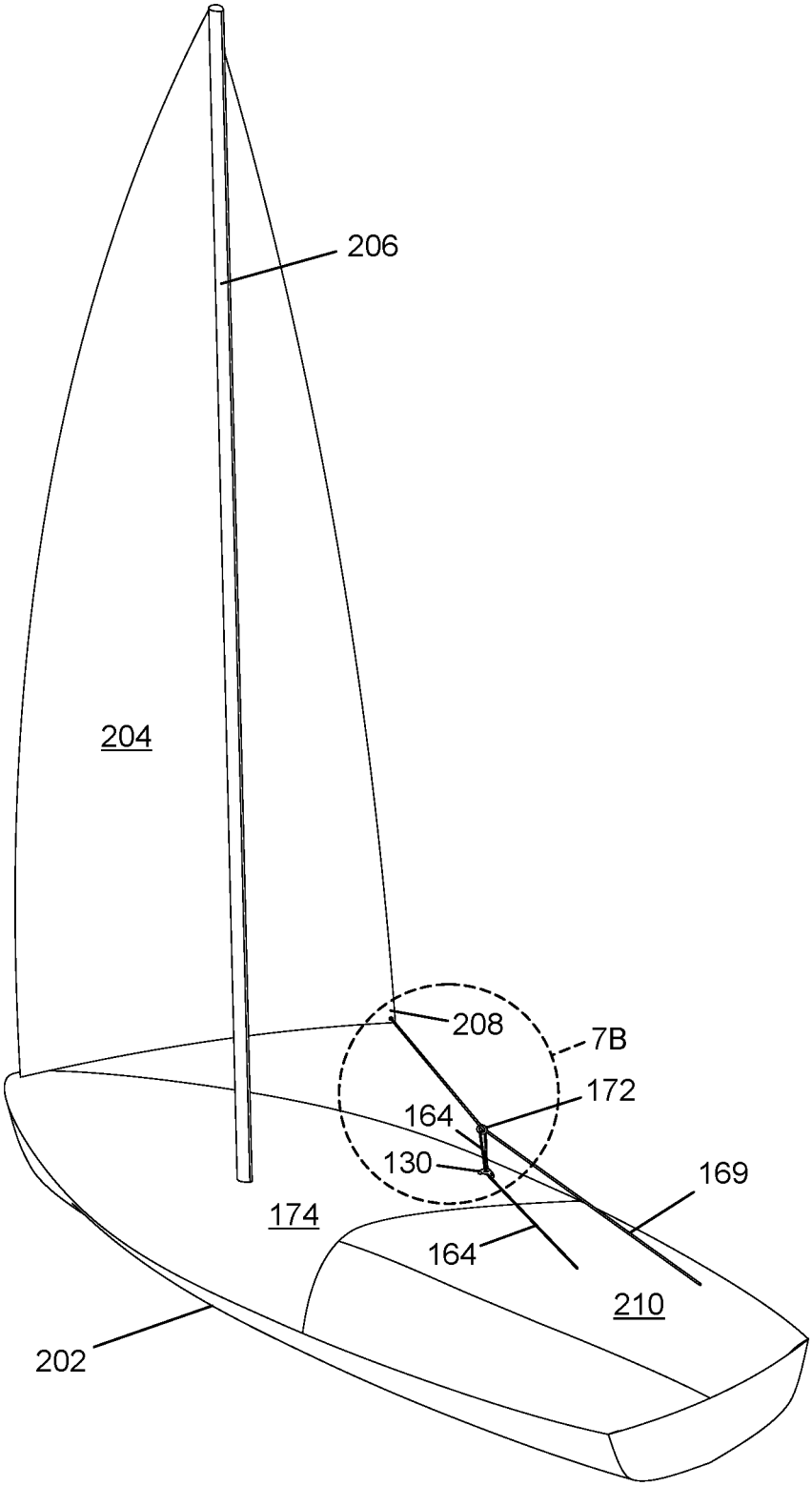
FIG. 7A is an illustration of the first presented embodiment of the device showing a typical "in-hauler" arrangement on a sailboat.

FIG. 7A shows a typical "in hauler" 2:1 arrangement on a sailboat using the first presented embodiment configuration 130, although other presented embodiments could also be employed. Typical sailboat 202 comprises of jib sail 204 and mast 206. Jib sail 204 contains sail clew 208. Embodiment 130 is shown mounted to boat deck 174. The jib sheet 169 connects to jib clew 208 and is deflected by a typical rigging "bull's eye" 172. Jib sheet 169 eventually terminates on its other end to a typical winch or cleat which is not shown. The in-hauler line 164 is shown terminated to the presented embodiment 130 in a pad eye arrangement and then passing through, or around, a typical rigging "bull's eye" 172 which is used to deflect jib sheet 169 and further control the aerodynamic shape of jib sail 204. In-hauler line 164 then runs back through presented embodiment 130 from an essentially vertical direction and is redirected to an essentially horizontal direction by embodiment 130 in a fairlead arrangement. It is understood that embodiment 130 is employed for illustration purposes and the illustration is not limited to embodiment 130 and could also employ other presented embodiments in the same function. In-hauler line 164 then runs back to boat cockpit 210. A magnified area is indicate by circle 7B and is described in the subsequent FIG. 7B.

Figure 7B:
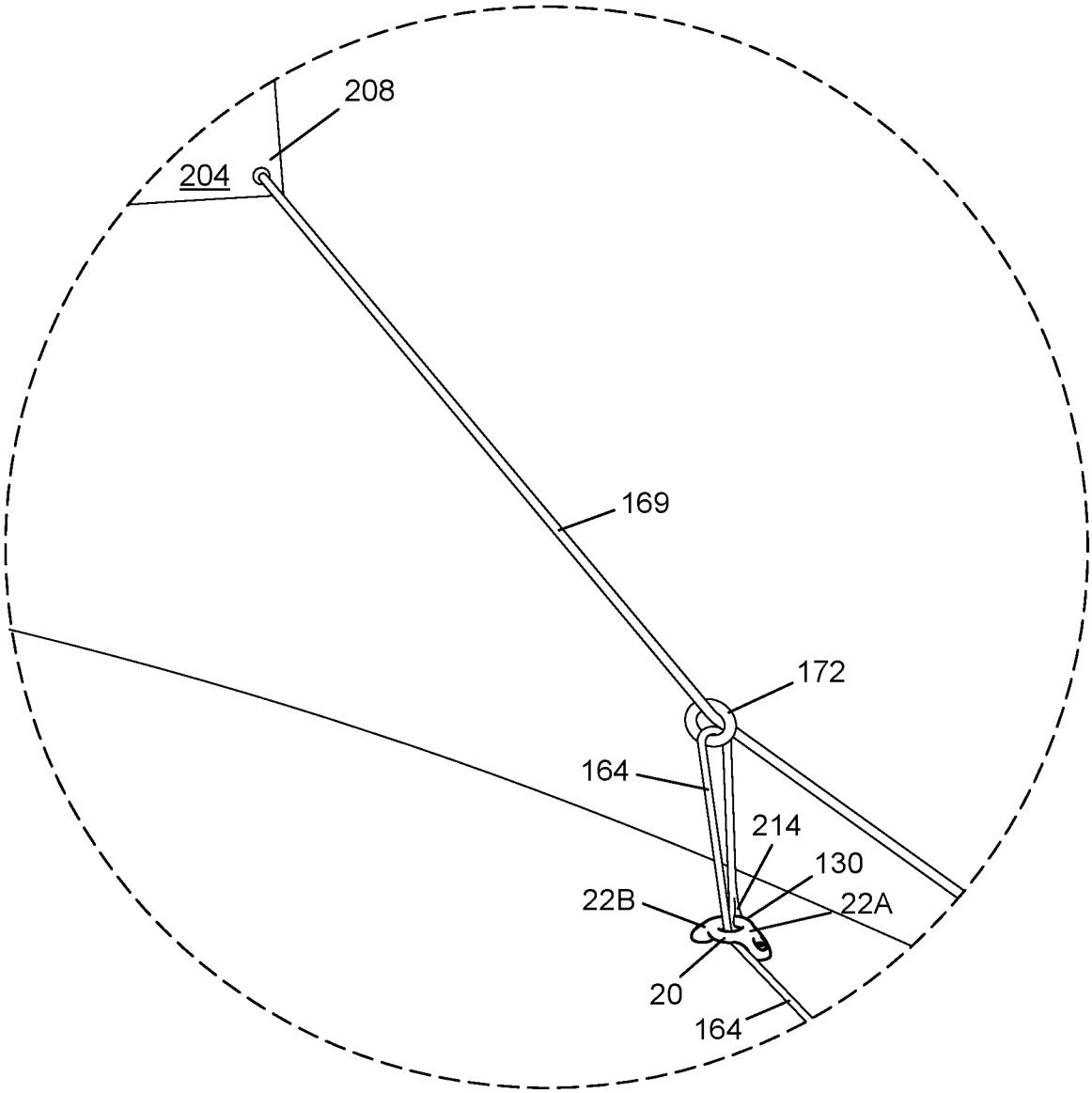
FIG. 7B is a magnified view of FIG. 7A further detailing the presented device in an "in-hauler" arrangement.

FIG. 7B is a magnified view of FIG. 7A showing more detail to the "in-hauler" 2:1 arrangement. In-hauler line 164 is attached by a knot or splice 214 to one side of annular ring 20 of presented embodiment 130. In-hauler line 164 then runs upward essentially vertically through or around typical rigging "bull's eye" 172 and then back downward though the center of annular ring 20 of presented embodiment 130. Typical rigging "bull's eye" 172 passes around jib sheet 169. In-hauler line 164 is redirected from an essentially vertical direction to an essentially horizontal direction by presented embodiment 130. The direction of in-hauler line 164 can be further redirected in a fairlead arrangement by being deflected by the side of either leg 22A or leg 22B.

Figure 8A:
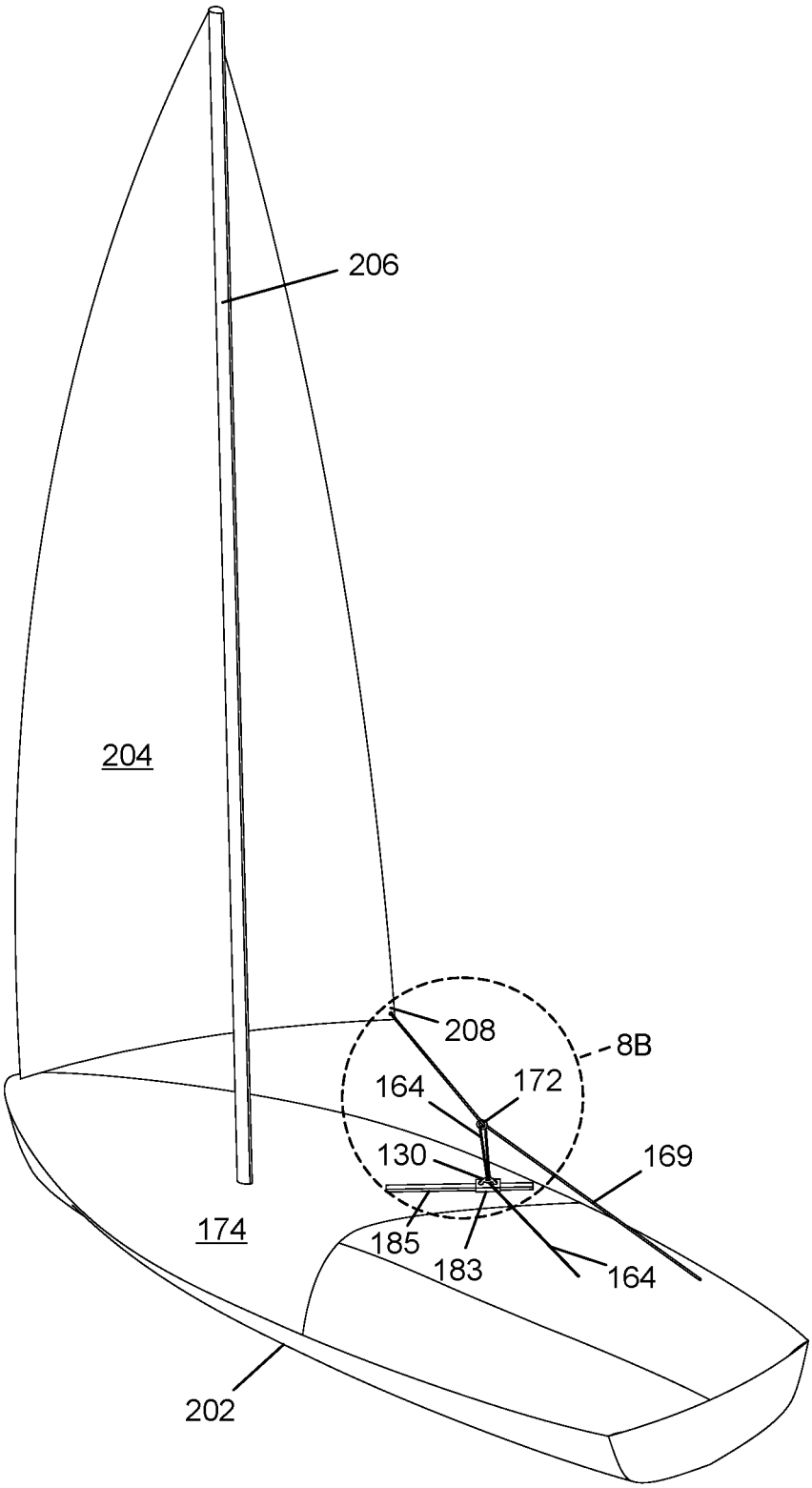
FIG. 8A is a view of the first presented embodiment of the device showing a typical "barber-hauler" arrangement on a sailboat.

FIG. 8A presents embodiment 130 mounted on or made integral to a typical sailboat "traveler" type car 183 so as to create a "barber hauler" arrangement. Typical sailboat 202 comprises of jib sail 204 and mast 206. Jib sail 204 contains sail clew 208. Presented embodiment 130 is mounted or made integral to typical traveler car 183. It should be noted that the arrangement is not limited to embodiment 130 and could employ other presented embodiments as well. Traveler car 183 is mounted with a prismatic joint to typical traveler car track 185 so as to allow an essentially athwartship direction of movement along boat deck 174. This essentially athwartship translation of presented embodiment 130, mounted or made integral to traveler car 183, allows for further change of the lead angle of jib sheet 169 with respect to sail clew 208. By pulling on or easing out on in-hauler line 164 and positioning traveler car 183 in a selected athwartship location, further adjustment to the aerodynamic shape of jib sail 204 is made possible. A magnified area is indicate by circle 8B and is described in the subsequent FIG. 8B.

Figure 8B:
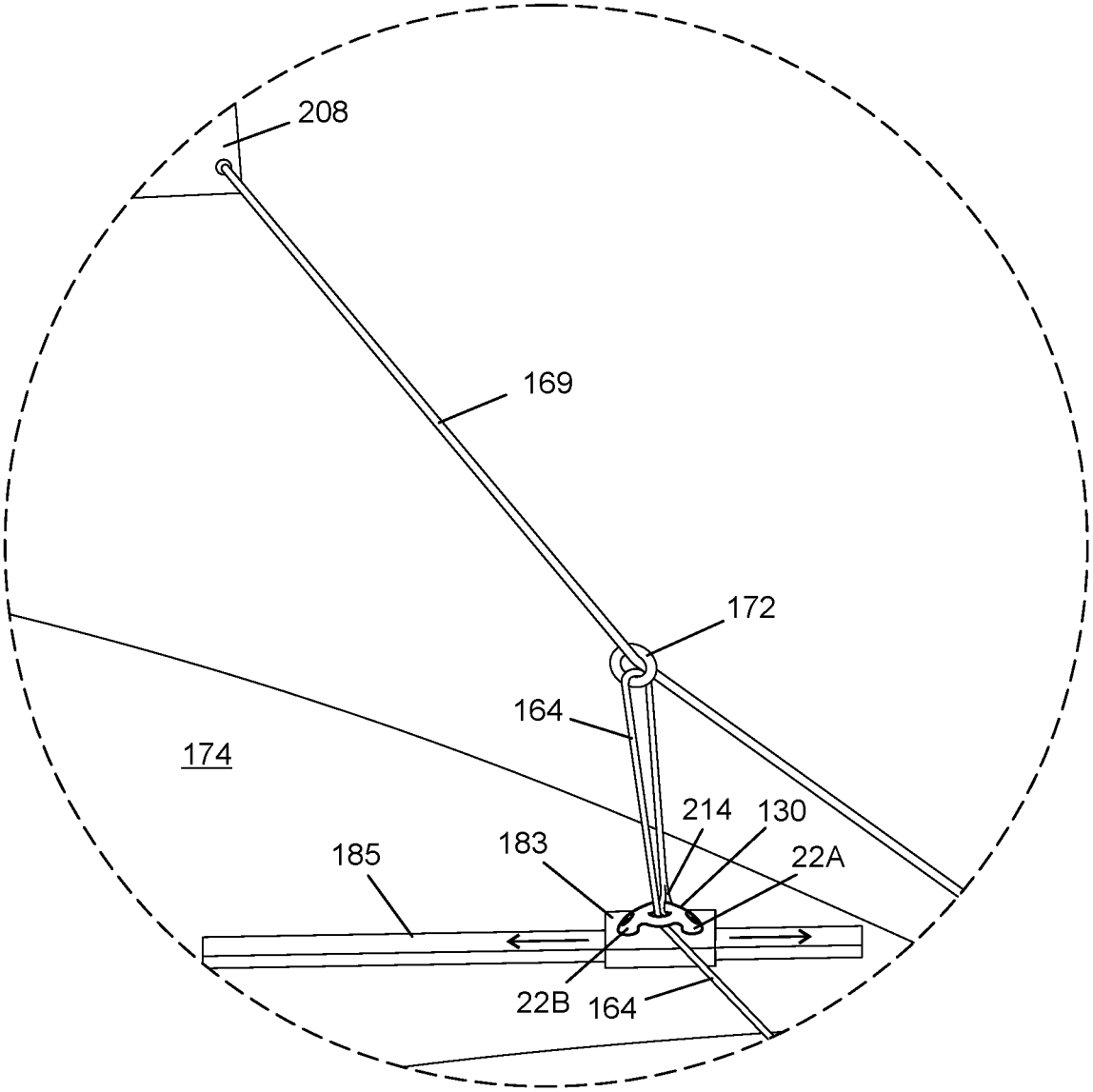
FIG. 8B is a magnified view of the first presented embodiment of the device further detailing a typical "barber-hauler" arrangement on a sailboat.

FIG. 8B is a magnified view of 8B showing more detail to the "barber hauler" arrangement mounted on boat deck 174. Presented embodiment 130 is mounted to the upper structural surface of traveler car 183 or alternatively presented embodiment 130 or any other presented embodiments could be made integral to the upper structural surface of traveler car 183 so as to create a traveler car with such presented embodiment formed into its structure. In-hauler line 164 is attached to embodiment 130 by a knot or splice 214, run through or around a typical rigging "bulls eye" 172 and then looped back through annular ring 20 and then between adjacent legs 22A and 22B of embodiment 130 so as to act as a fairlead. Typical rigging "bull's eye" 172 is passed around jib sheet 169. Traveler car 183 can move laterally along traveler track 185 so as the change the in-hauler line 164 direction of pull with respect to typical rigging "bull's eye" 172, which in turn changes the lead angle of jib sheet 169 with respect to jib sail clew 208. It is understood that presented embodiment 130 used with this figure could be substituted with other presented embodiments as well and is not limited to only embodiment 130.

The presented embodiments are generally intended to be constructed from metal such as aluminum or stainless steel but could be constructed out of any other suitable materials including plastics and composites. Fabrication methods include machining, investment casting, injection molding, forging or any other suitable fabrication process. Further processing may include anodizing, electropolishing, tumbling, powder coating, or any other such secondary processes.

What is claimed:

1. A combination pad eye and fairlead device comprising:

a) an annular ring having an inner and outer diameter, and b) a plurality of legs protruding from said annular ring at spaced locations so as to be able to support said annular ring in an orientation parallel to, or canted at a predetermined angle to, a surface onto which said legs rest upon, and c) each said leg having a base portion with a flat planar lower surface, with each said flat base lower surface being essentially coplanar with another said flat base lower surface, whereby said flat planar lower surfaces of said base portions of said legs of said combination pad eye and fairlead device can be joined and mated to the corresponding said flat planar lower surfaces of said base portions of said legs of a second but inverted said device by use of bolts, screws or other means of fastening so as to form a single combined unit.

2. The device of claim 1 further comprising of fillets and rounds of predetermined dimensions on the surfaces of said legs and on the corresponding surfaces of said legs of the second but inverted said mated device, with said predetermined fillet and round dimensions made in accordance to the line material characteristics so as to not cause damage to a line when bending around said fillets and rounds.

3. The device of claim 1 further comprising of the two said combination pad eye and fairlead devices made integral to each other in the form of one single manufactured component.

4. The device of claim 1 whereas said combined device is constructed from metal, plastic, wood, a composite material or any other suitable structural material.

5. The device of claim 1 whereas the material that said device is constructed from is further anodized, plated or coated with a material to modify friction and/or to reduce wear.

6. A combination pad eye and fairlead device comprising:

a) an annular ring having an inner and outer diameter, and b) a plurality of legs protruding from said annular ring at spaced locations so as to be able to support said annular ring, in an orientation parallel to, or canted at a predetermined angle to, a surface onto which said legs rest upon and c) a base comprising of an upper structural body of a sailboat traveler car, whereby (a) a line or multiple lines can be attached around the said inner and said outer diameter of said annular ring with a knot or other means of attachment so that said annular ring functions as a pad eye, (b) said inner and said outer diameters of said annular ring can independently and simultaneously redirect another line or lines by providing a point of contact between said lines and said annular ring to deflect and redirect said lines in the function of a fairlead (c) the surfaces on the outside of said legs protruding from said annular ring create physical barriers to restrain the side to side movement of said lines around the perimeter of said annular ring so as to create regions of separation between the pad eye and fairlead functions of uses and (d) said combination pad eye and fairlead device is mounted to or made integral to said base comprising of said upper structural body of said sailboat traveler car.

7. The device of claim 6 whereas the said device is constructed of separate components or as a single element from metal, plastic, wood, a composite material or any other suitable structural material.

8. The device of claim 6 whereas the material that said device is constructed from is further anodized, plated or coated with a material to modify friction and/or to reduce wear.

9. A combination pad eye and fairlead device comprising:

a) an annular ring comprising of an outer diameter and an inner bore, b) whereas the geometry of said annular ring is created by a surface of revolution revolved about an axis passing through the center of, and orthogonal to, the diameter of said inner bore, c) and whereas said surface of revolution revolved about said axis is created by a closed curve, with the perimeter of said closed curve comprised of only convex curvatures, d) and whereas said inner bore of said annular ring has no protrusions, steps, or bottom projecting inward from the walls of said inner bore, thus allowing a line or rope to pass unrestricted through the entirety of said inner bore, e) a plurality of legs protruding from said annular ring at spaced locations so as to be able to support said annular ring in an orientation parallel to, or canted at a predetermined angle to, a surface onto which said legs rest upon, whereby (a) a line or multiple lines can be passed through said inner bore and around said outer diameter of said annular ring with a knot or other means of attachment so that said annular ring functions as a pad eye, (b) said inner bore and said outer diameter of said annular ring can independently and simultaneously redirect another line or lines by providing a point of contact between said lines and said annular ring to deflect and redirect said lines in the function of a fairlead (c) the surfaces on the outside of said legs protruding from said annular ring create physical barriers to restrain the side to side movement of said lines around the perimeter of said annular ring so as to create regions of separation between the pad eye and fairlead functions of uses, f) and whereas said outer diameter of said annual ring, and the outer surfaces of said plurality of legs protruding from said annular ring, are free from any protruding horns or appendages so as to minimize snag hazards of objects dragged over the exterior of said combination pad eye and fairlead device.

10. The device of claim 9 whereas the contours defining the outside surfaces of said protruding legs follow a continuous convex curve from their initial protrusion transition with said outer diameter of said annular ring to their locations of contact with said surface upon which said legs rest.

11. The device of claim 9 whereas the outside diameter and the inner bore of said annular ring is comprised of a section, or multiple sections, free of said legs whereas to provide a region, or multiple unconnected regions, for wrapping a line or lines around the outside diameter, and through the inner bore of, said annular ring.

12. The device of claim 9 whereas said inner bore of said annular ring is sized to a predetermined dimension, whereby a line or multiple lines can pass through the interior of said inner bore, out the opposing side of said inner bore, and then out under said region created between the bottom of said annular ring and said surface upon which said legs rest upon, in the function of a fairlead.

13. The device of claim 9 further comprising of an optional stiffening plate to provide more rigidity to said mounting surface.

14. The device of claim 9 further comprising said legs whereby the sides of said legs are rounded to predetermined dimensions so said legs act as additional fairlead surfaces to further deflect and redirect said line(s) through additional turning angles, with said rounded sides of said legs made to predetermined dimensions in accordance to the line material characteristics so as to not cause damage to the line when bending around said rounded sides of said legs.

15. The device of claim 9 whereas said edges of said inner bore and outer diameter of said annular ring are radiused to predetermined dimensions with said predetermined dimensions made in accordance to the line material characteristics so as to not cause damage to the line when bending around said inside and outside diameter rounded edges.

16. The device of claim 9 whereas the material that said device is constructed from is further anodized, plated or coated with a material to modify friction and/or to reduce wear.

* * * * *